US007959251B2

(12) United States Patent
Furukawa

(10) Patent No.: US 7,959,251 B2
(45) Date of Patent: Jun. 14, 2011

(54) IMAGE FORMING DEVICE AND LABEL PRINTER

(75) Inventor: Koji Furukawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 750 days.

(21) Appl. No.: 11/863,073

(22) Filed: Sep. 27, 2007

(65) Prior Publication Data

US 2008/0074453 A1 Mar. 27, 2008

(30) Foreign Application Priority Data

Sep. 27, 2006 (JP) ..... 2006-262407

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 6,106,094 | A | 8/2000 | Otani et al. | |
| 2003/0231234 | A1* | 12/2003 | Ushirogouchi et al. | 347/100 |
| 2004/0157030 | A1* | 8/2004 | Frankhuisen | 428/42.3 |
| 2008/0029221 | A1* | 2/2008 | Dangami et al. | 156/379 |

FOREIGN PATENT DOCUMENTS

| | | | | |
|---|---|---|---|---|
| DE | 203 03 574 | U1 | | 4/2003 |
| JP | 2002-307724 | A | | 10/2002 |
| JP | 2003-341217 | A | | 12/2003 |
| JP | 2004268584 | A | * | 9/2004 |
| WO | WO 2006011395 | A1 | * | 2/2006 |

OTHER PUBLICATIONS

EP Communication, dated Mar. 10, 2009, issued in corresponding EP Application No. 07018935.2, 3 pages.

* cited by examiner

*Primary Examiner* — Laura E Martin
(74) *Attorney, Agent, or Firm* — Sughrue Mion, PLLC

(57) ABSTRACT

The image forming device includes an image forming unit that forms images on a surface of a web-type recording medium, a printing defect detecting unit that detects a defective image with a printing defect from among the images formed by the image forming unit and a printing defect marking unit that places a mark on the defective image with the printing defect having been detected. The label printer includes the image forming device described above, wherein the images formed on the surface of the web-type recording medium by the image forming unit of the image forming device are label images and the specific image is a specific label image and a post-treatment unit that post-treats the surface of the web-type recording medium having the label images formed thereon by the image forming unit.

11 Claims, 8 Drawing Sheets

IMAGE FORMING DEVICE AND LABEL PRINTER

The entire contents of all documents cited in this specification are incorporated herein by reference.

BACKGROUND OF THE INVENTION

The present invention relates to an image forming device and a label printer.

For example, label printing has been conventionally performed by various printing methods such as flexographic printing, offset printing, and relief printing, but digital printing methods making use of electrophotography or ink-jet printing technology have been very often used recently in order to meet the demand for reducing the lot size and the number of waste sheets. Along with such printing digitization, the post-process of label printing adopts digitization and digital control laser cutting machines are commercialized. Laser machining greatly improves the flexibility in the cutting shape and labels are also required to have a more complicated shape than the conventional simple shapes such as quadrangle and circle.

SUMMARY OF THE INVENTION

In this connection, commonly assigned Japanese Patent Application No. 2006-116743 discloses a digital label printer which comprises image forming means for forming an image based on a digital image signal on a web-type recording medium for printing labels, post-treatment means for post-treating the recording medium after recording, and means for changing the transport speed in the post-treatment step according to the position at which a label is treated with the post-treatment means based on label edge data in digital image signals.

It is also proposed as for this digital label printer that the post-treatment step may include a die cutter for making label-shaped slits and a section for peeling off unnecessary portions, that is, portions other than the label portions, and the post-treatment step transport speed changing means may slow, based on label shape data, the transport speed of the recording medium at positions of label portions that are vulnerable to the peeling of unnecessary portions, or alternatively that the post-treatment step may include a laser cutter and a section for peeling off unnecessary portions, that is, portions other than the label portions and the post-treatment step transport speed changing means may slow the transport speed of the recording medium at label edge portions having high density image data.

In the actual label printing process, however, labels (individual labels) printed with the aforementioned digital label printer are not always in a satisfactory state of printing and some of the labels may be poor in quality due to occurrence of a printing defect attributable to ink ejection failure in the ink-jet printing process.

In such a case, in the conventional label printing process, an inspection worker located downstream of the digital label printer usually checks the whole of the labels by visual inspection. In the case where a label was found to be poor in quality during the inspection, the inspection worker made manual repairs by peeling off the corresponding defective label and affixing a previously prepared correct label (i.e., label in a satisfactory state of printing) at the same position.

However, since labels printed in a plurality of rows must be continuously checked by visual inspection, this inspecting operation had difficulties in completely eliminating inspection errors such as overlooking defective goods and solving the problem of an increase in the level of fatigue experienced by inspection workers.

The problems of this type may also occur in other processes than the label printing process.

The present invention has been made to solve the aforementioned problems and a first object of the present invention is to provide an image forming device that is applied to such a printing process as a label printing process where a plurality of prints are continuously checked.

A second object of the present invention is to provide a label printer in which the image forming device is used.

In order to achieve the first object, the invention provides an image forming device comprising: image forming means for forming images on a surface of a web-type recording medium; printing defect detecting means for detecting a defective image with a printing defect from among the images formed by the image forming means; and printing defect marking means for placing a mark on the defective image with the printing defect having been detected.

The image forming means preferably comprises an ink-jet head that uses ink which is curable upon exposure to active energy rays.

The printing defect detecting means preferably detects ejection failure of the ink-jet head.

Preferably, the image forming means forms the images on the surface of the web-type recording medium based on drawing image data previously stored for the images to be formed, and the printing defect detecting means compares first image data obtained by reading a specific image in the images formed on the surface of the web-type recording medium by the image forming means with second image data used for forming the specific image in the drawing image data and determines whether or not the specific image recorded on the surface of the recording medium is correct.

Preferably, the image forming device further comprises: storage means for previously storing drawing image data to be used for forming the images on the surface of the web-type recording medium by means of the image forming means; and image detecting means for reading a specific image in the images formed on the surface of the web-type recording medium by the image forming means to obtain first image data, and the printing defect detecting means compares the first image data of the specific image read by the image forming means with second image data used for forming the specific image in the drawing image data and determines whether the specific image recorded on the surface of the recording medium is a correct image or the defective image with the printing defect.

In order to achieve the second object, the invention provides a label printer comprising: the image forming device, wherein the images formed on the surface of the web-type recording medium by the image forming means of the image forming device are label images and the specific image is a specific label image; and post-treatment means for post-treating the surface of the web-type recording medium having the label images formed thereon by the image forming means.

More specifically, the label printer comprises: the image forming means for forming label images on a surface of a web-type recording medium; the post-treatment means for post-treating the surface of the web-type recording medium having the label images formed thereon by the image forming means; printing defect detecting means for detecting a defective image with a printing defect from among the label images formed by the image forming means; and printing defect marking means for placing a mark on the defective image with the printing defect having been detected.

The image forming means preferably comprises an ink-jet head that uses ink which is curable upon exposure to active energy rays.

The printing defect detecting means preferably detects ejection failure of the ink-jet head.

Preferably, the image forming means forms the label images on the surface of the web-type recording medium based on drawing image data previously stored for the label images to be formed, and the printing defect detecting means compares first image data obtained by reading a specific label image in the label images formed on the surface of the web-type recording medium by the image forming means with second image data used for forming the specific label image in the drawing image data and determines whether or not the specific label image recorded on the surface of the recording medium is correct.

Preferably, the label printer further comprises: storage means for previously storing drawing image data to be used for forming the label images on the surface of the web-type recording medium by means of the image forming means; and image detecting means for reading a specific label image in the label images formed on the surface of the web-type recording medium by the image forming means to obtain first image data, and the printing defect detecting means compares the first image data of the specific label image read by the image forming means with second image data used for forming the specific label image in the drawing image data and determines whether the specific label image recorded on the surface of the recording medium is a correct label image or the defective image with the printing defect.

The present invention has a marked effect in realizing an image forming device applied to such a printing process as a label printing process where a plurality of prints are continuously checked, and a label printer in which the image forming device is used.

More specifically, the present invention can have an extremely practical effect that inspection errors such as overlooking defective goods can be completely prevented in the image forming device applied to such a printing process as a label printing process where a plurality of prints are continuously checked, and in the label printer in which the image forming device is used.

BRIEF DESCRIPTION OF THE INVENTION

DETAILED DESCRIPTION OF THE INVENTION

The image forming device and the label printer of the invention are described more fully below based on the preferred embodiments shown in the accompanying drawings. In the following embodiments, digital label printers which use an ink-jet recording device are employed by way of illustration to describe the invention.

The digital label printers according to these embodiments carry out image formation by curing only the interior of the undercoat liquid which has been applied onto a recording medium, then ejecting onto the undercoat which has been cured only at the interior, at least one ink that cures upon exposure to active energy rays.

Figure 1:
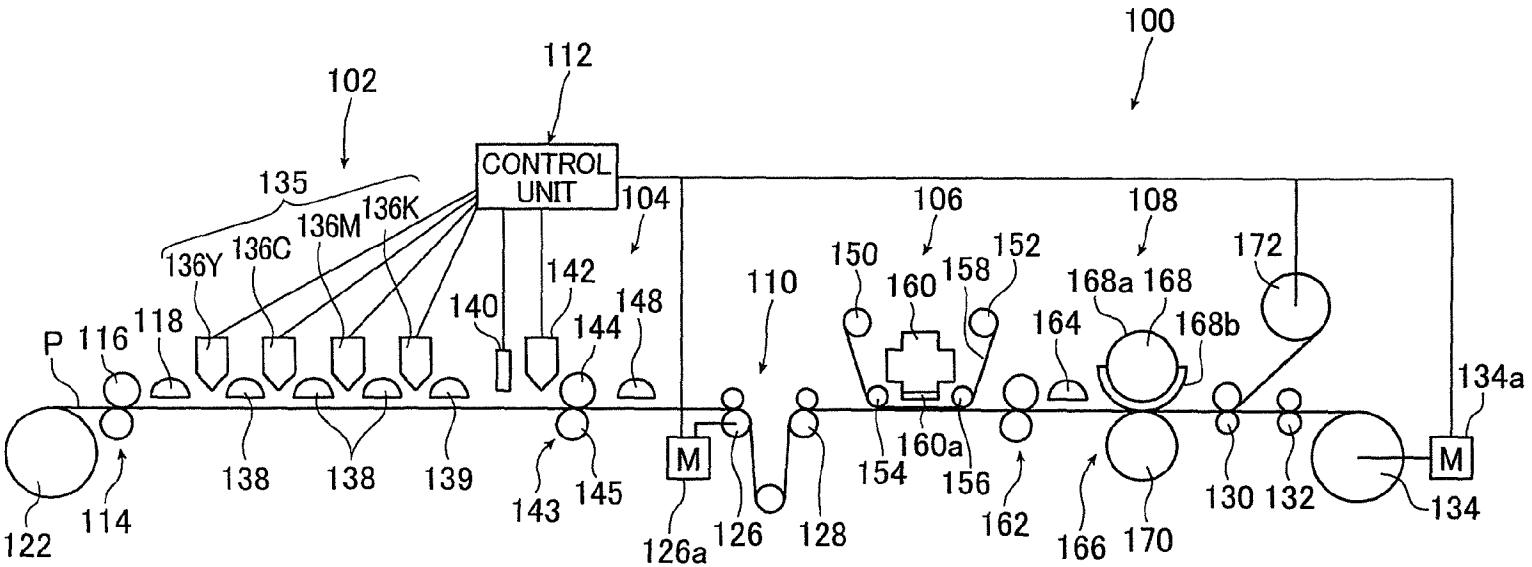
FIG. 1 is a front view showing, in simplified form, an embodiment of a digital label printer of the invention which employs an ink-jet recording device as an example of an image forming device according to the invention.
Figure 2:
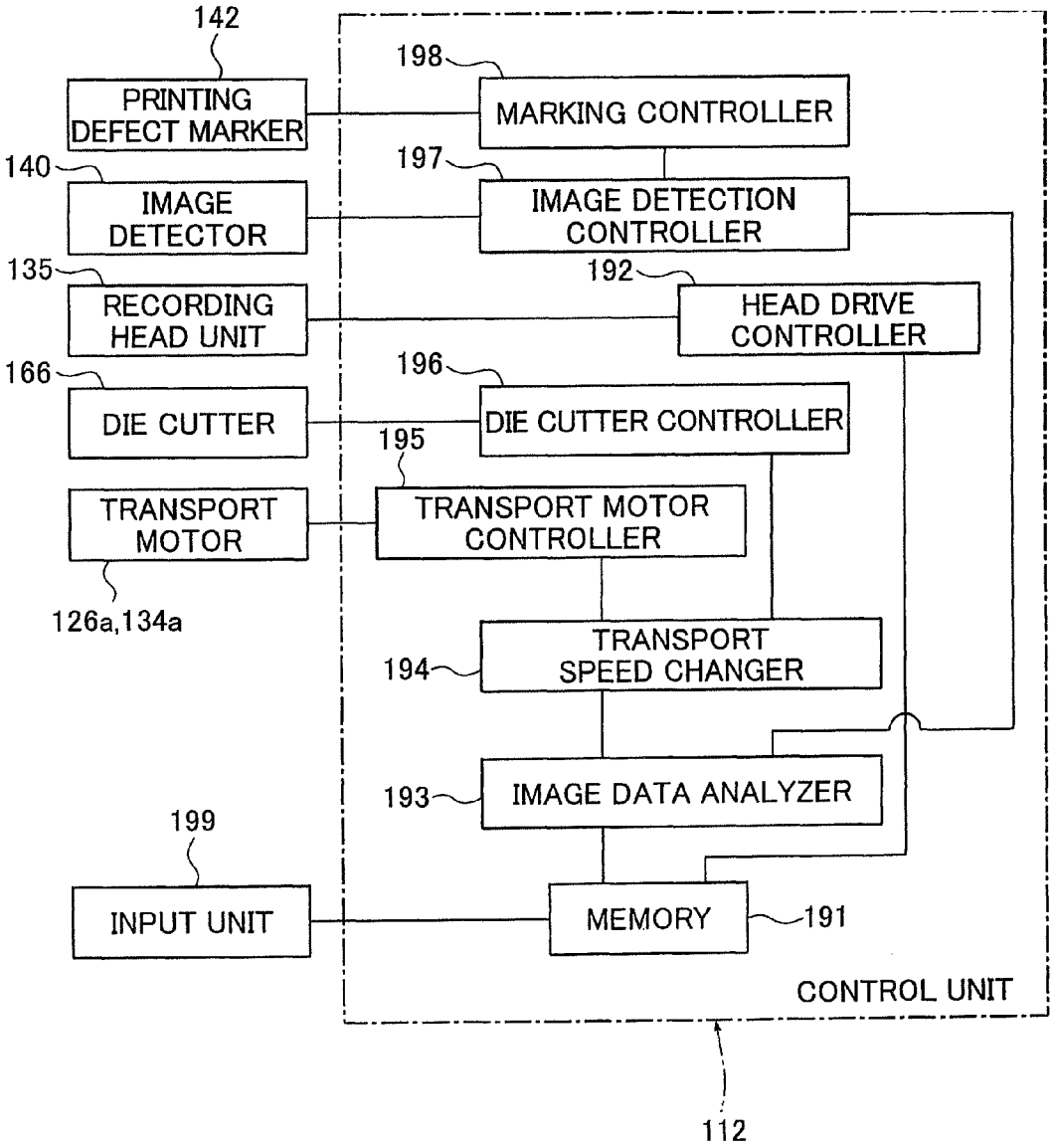
FIG. 2 is a block diagram illustrating a control unit for controlling the digital label printer shown in FIG. 1.
Figure 3:
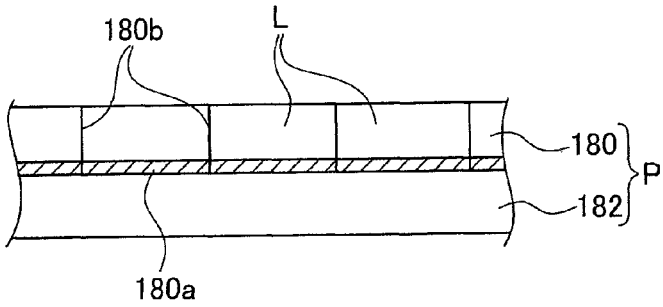
FIG. 3 is a longitudinal sectional view of a recording medium for printing labels such as may be used in the digital label printer shown in FIG. 1.

FIG. 1 is a front view showing, in simplified form, a digital label printer of the invention which uses an ink-jet recording device as an example of an image forming device according to one embodiment of the invention, FIG. 2 is a block diagram illustrating a control unit for controlling the digital label printer shown in FIG. 1, and FIG. 3 is a longitudinal sectional view of a recording medium for printing labels such as may be used in the digital label printer shown in FIG. 1.

A digital label printer 100 shown in the present embodiment prints an image onto a web-type recording medium P for printing labels (also referred to below as simply "the recording medium") at an image-recording section (also called image-drawing section) 102, then makes label-shaped slits in the medium P with a die cutter in a post-treatment section 108. In addition, the printer 100 carries out, as a subsequent step, a waste removal operation in which unnecessary portions of the pressure-sensitive adhesive sheet are peeled from the backing sheet (peel sheet) and removed.

In each of the embodiments appearing below, an active energy curing-type digital label printer which uses a UV-curable ink as the active energy-curable ink that cures upon exposure to active energy is described by way of illustration. However, the invention is not limited in this regard, and may be applied to digital label recording devices which use any of various kinds of active energy-curable inks, as well as to any other type of digital label printer.

Referring to FIG. 3, the recording medium P used in the present embodiment has a two-layer construction composed of a peel sheet 182 as a backing sheet on which is laminated a pressure-sensitive adhesive sheet 180 coated on the back side thereof with a pressure-sensitive adhesive 180*a*.

As shown in FIG. 1, the digital label printer 100 has the image-recording section 102 that uses the image forming device of the invention, a surface smoothing section 104, a foil stamping section 106, the post-treatment section 108, a transport section 110, and a control unit 112.

Here, the transport section 110 transports the recording medium P in a fixed direction (from left to right in FIG. 1). The image-recording section 102, the surface smoothing section 104, the foil stamping section 106 and the post-treatment section 108 are arranged in this order in the direction of travel of the recording medium P; that is, in the upstream to downstream direction. The control unit 112 is connected to the image-recording section 102, the surface smoothing section 104, the foil stamping section 106, the post-treatment section 108 and the transport section 110, and controls their respective operations.

The transport section 110 has a feed roll 122, transport roller pairs 126, 128, 130 and 132, a product roll 134, and transport motors 126*a* and 134*a*.

The feed roll 122 has the recording medium P wound thereon in the form of a roll.

The transport roller pairs 126, 128, 130 and 132 are arranged in this order from the upstream to the downstream side of the travel path of the recording medium P. These transport roller pairs 126, 128, 130 and 132 let out the recording medium P from the feed roll 122, and transport the recording medium P in a given direction (in the present embodiment, from left to right in FIG. 1).

The product roll 134, which is disposed the furthest downstream on the recording medium P travel path, i.e., in the direction of transport, takes up the recording medium P that has been transported over the travel path by the transport roller pairs 126, 128, 130 and 132 and has passed through the image-recording section 102, the surface smoothing section 104, the foil stamping section 106 and the post-treatment section 108.

The transport motors 126*a* and 134*a* are connected to, respectively, the transport roller pair 126 and the product roll 134, and rotatably drive the transport roller pair 126 and the product roll 134.

That is, in the present embodiment, the transport roller pair 126 and the product roll 134 connected to the transport motors 126*a* and 134*a*, respectively, are driven to rotate and thus serve as the drive rollers for transporting the recording medium P. The other transport roller pairs 128, 130 and 132 are driven rollers which rotate with movement of the recording medium P and regulate the recording medium P on the travel path.

In the transport section 110, the transport motors 126*a* and 134*a* rotatably drive the transport roller pair 126 and the product roll 134. Through this arrangement, the recording medium P is let out from the feed roll 122, passes through the image-recording section 102, the surface smoothing section 104, the foil stamping section 106 and the post-treatment section 108, and is taken up by the product roll 134.

In the present embodiment, a transport buffer is provided between the image-recording section 102 and the surface smoothing section 104 on the one side and the foil stamping section 106 and the post-treatment section 108 on the other side.

By providing such a transport buffer, it is possible to absorb slack that arises in a web-type recording medium P for printing labels due to a difference between the transport speed in the image-recording section 102 and the surface smoothing section 104, and the transport speed in the foil stamping section 106 and the post-treatment section 108, thus enabling the labels to be efficiently produced.

The transport motors 126*a* and 134*a* are connected to the subsequently described control unit 112 and their rotational speeds thereby controlled. This in turn controls the speed at which the web-type recording medium P for printing labels is transported by the transport section 110.

No particular limitation is imposed on the transport roller pairs which function as drive roller pairs. For example, transport motors may be provided for all the transport roller pairs, so that all the transport roller pairs function as drive roller pairs.

The image-recording section 102 has an undercoat-forming section 114, a recording head unit 135 which is an image forming means, UV irradiators 138 and 139, an image detector 140 which is a printing defect detecting means and a printing defect marker 142.

The recording head unit 135 has recording heads (ink-jet heads) 136Y, 136C, 136M and 136K which are arrayed at positions facing the travel path of the recording medium P. That is, the ink nozzle tips are arranged so as to face the recording medium P.

As described above, the digital label printer 100 according to the present embodiment carries out image formation by curing only the interior of an undercoat liquid which has been applied onto the recording medium P, then ejecting onto the undercoat having cured only at the interior at least one ink which cures only at the interior upon exposure to active energy rays.

Here, the undercoat-forming section 114 has a roll coater 116 which applies an undercoat liquid onto the surface of the recording medium P, and a UV irradiator 118 for curing only the interior of the applied undercoat liquid. The digital label printer 100 carries out image formation by curing only the interior of at least one undercoat liquid having been applied onto the recording medium P in the undercoat-forming section 114, then ejecting at least one ink from the subsequent recording head unit 135 onto the undercoat liquid that has been cured only at the interior.

"Internal curing," refers herein to a state where the interior of the undercoat liquid has completely or partially cured, but the surface of the undercoat liquid has a lower degree of cure than the interior and possesses a degree of fluidity. Whether such curing has occurred can be determined based on whether, when a permeable medium such as plain paper is pressed against the applied undercoat liquid following completion of the internal curing step (e.g., following exposure to active energy rays or heating) but prior to deposition of the ink droplets, the surface of the undercoat liquid transfers to the permeable medium.

The recording heads 136Y, 136C, 136M and 136K are arranged, from the upstream to the downstream side in the direction of travel of the recording medium P, in the following order: recording head 136Y, recording head 136C, recording head 136M, recording head 136K.

The recording heads 136Y, 136C, 136M and 136K are full-line type piezoelectric ink-jet heads having a large number of ejection nozzles (nozzles or ink ejecting portions) for ejecting the ink arrayed at fixed intervals over the entire width of the recording medium P (that is, orthogonal to the direction of travel of the recording medium P), and are connected to a head drive controller 192 of the subsequently described control unit 112 and an ink storage/loading section (not shown). The head drive controller 192 controls the amount and timing of ink droplet ejection at the recording heads 136Y, 136C, 136M and 136K.

As the recording medium P is transported by the transport section 110, inks of the respective colors are ejected onto the recording medium P from the recording heads 136Y, 136C, 136M and 136K, thereby forming a color image on the surface of the recording medium P.

In this embodiment, the recording heads are not limited to piezo elements (piezoelectric elements). Any of various systems may be used in place of a piezo system, such as a thermal jet system which uses a heating element such as a heater to heat ink and generate bubbles. In this latter system, the pressure of the bubbles propels the droplets of ink.

The inks ejected from the respective recording heads 136Y, 136C, 136M and 136K in this embodiment are UV-curable inks.

For each of the recording heads 136Y, 136C and 136M, a UV irradiator 138, which is an active energy-irradiating light source, is disposed on the downstream side of each recording head 136Y, 136C or 136M. In addition, another UV irradiator 139 is disposed on the downstream side of the recording head 136K. Various types of ultraviolet light sources, such as metal halide lamps, high-pressure mercury vapor lamps and ultraviolet LEDs may be used as the UV irradiators 118, 138 and 139.

The UV irradiators 138 and 139 expose to ultraviolet light the recording medium P which has passed recording positions facing the respective recording heads 136Y, 136C, 136M and 136K and on which an image has been formed.

Immediately after ink has been ejected from the recording heads and deposited on the surface of the recording medium P, the UV irradiators 138 irradiate the ink on the surface of the recording medium P with energy for curing only the interior of the ink, thereby curing the ink on the surface of the recording medium P. The subsequent UV irradiator 139 more completely cures the undercoat that has been cured at the interior only by the UV irradiator 118 and the respective color ink layers that have been formed thereon and cured at the interior only by the earlier UV irradiators 138. The image-recording section 102 of the digital label printer 100 according to the present embodiment thus employs this type of curing process.

It is preferable for the UV irradiators 138 and 139 to be positioned or configured in such a way that the UV light which is emitted irradiates ink on the surface of the recording medium P, but does not irradiate the ink nozzles on the recording heads 136Y, 136C, 136M and 136M. By thus preventing UV light from irradiating the ink nozzles, the ink can be prevented from curing at the nozzles.

Preferably, a measure for preventing light reflection (e.g., matte black treatment) is provided at each of the areas in the vicinity of the UV irradiators 138 and 139.

The image detector 140 and the print defect marker 142 are disposed at a stage subsequent to the recording head unit 135 within the image-recording section 102.

The image detector 140 is composed of an imaging means which uses, for example, a charged coupled device (CCD), and is used to detect whether the image recorded on the surface of the recording medium P is correct by comparing in the control unit 112 image data that has been read with prestored data on the image to be formed as will be described later.

The degree of coincidence or degree of non-coincidence between the image data having been read and the data on the image to be recorded may be calculated from the comparison results of both the pieces of image data such that whether or not the recorded image is correct can be determined within the control unit 112 based on the thus calculated degree of coincidence or degree of non-coincidence. More specifically, the error rate of an image is calculated as the degree of non-coincidence from the comparison results of both the pieces of image data for the image, and if the calculated error rate is not less than a preset specified threshold level, the image can be detected as an incorrect image, that is, a defective image with a printing defect. Instead of relying on the degree of non-coincidence such as the error rate, the degree of coincidence may be determined from the error rate so that the image can be detected as a defective image with a printing defect when the degree of coincidence is not more than a specified threshold level. The specified threshold level for detecting whether an image of interest is a normally printed image or a defective image with a printing defect may be appropriately determined by previously calculating the tolerable error rate of the image to be printed.

The print defect marker 142 is composed of an ink-jet recording head which, when the image detected by the image detector 140 is not a correct image that matches the image to be formed, that is, when the image detected by the image detector 140 is a defective printed image, prints a mark to this effect (e.g., a red cross (x)) on the defective printed image.

The image detector 140 is described above as being composed of an imaging means that uses a CCD, and the printing defect marker 142 is described as being composed of an ink-jet recording head. However, these are both illustrative, non-limiting, examples. In the practice of the invention, the image detector 140 and the printing defect marker 142 may of course be configured in other ways as well.

Figure 1A:
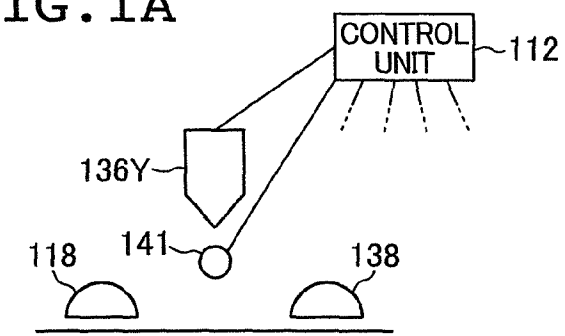
FIG. 1A is a partially enlarged view showing another layout of an ink-jet head in the digital label printer shown in FIG. 1.

Instead of or in addition to the image detector 140 for detecting a defective image due to a printing defect, the image-recording section 102 may include a recording head ejection failure detector 141 (see FIG. 1A) which detects the state of ejection of inks from the recording heads 136Y, 136C, 136M and 136K of the recording head unit 135 in the image-recording section 102, more specifically detects whether the inks are normally ejected. One or more of the recording heads may include the ejection failure detector 141, but it is preferable for each of the recording heads 136Y, 136C, 136M and 136K to include the ejection failure detector 141.

For such ejection failure detector 141, use may be made of an optical sensor which includes a light-emitting and a light-receiving device, more specifically a light-emitting source (e.g., an LD or an LED) and a light-receiving sensor (e.g., a light-receiving element) disposed so as to be opposed to each other with respect to the flight region or flight path of ink droplets from the recording head 136Y (136C, 136M or 136K). The optical sensor determines non-ejection from the recording head 136Y (136C, 136M or 136K) when laser light or luminescence emitted to the flight region or flight path during recording of one image passes therethrough and is detected by the optical sensor. For example, in the case where, when laser light or luminescence is continuously emitted during recording of one image to the flight region or flight path to which ink droplets are ejected from the recording head, the laser light is not blocked out but passes therethrough to be detected in spite of the presence of an image recording signal, namely an ejection signal, in other words, when the light having passed therethrough is detected but a light block signal synchronized with the ejection signal is not detected, the optical sensor determines that an ejection failure occurred.

Referring to ejection failure detection in the control unit 112, the optical sensor of the ejection failure detector 141 counts light block signals during recording of one image; the count is sent to an image detection controller 197 of the control unit 112, where the ratio of the number of signal pulses for ejection from the recording head to the sent count is calculated as the ejection ratio (degree of coincidence); when the calculated ejection ratio (degree of coincidence) is not more than a preset specified threshold level, a failure of ejection from the recording head is detected, enabling this image to be detected as a defective image due to an ejection failure. In this case as well, the degree of non-coincidence may be calculated from the ejection ratio so that the image can be detected as an defective image due to an ejection failure when the degree of non-coincidence is not less than a specified threshold level. The specified threshold level for detecting whether an image of interest is a defective image with a printing defect may be appropriately determined by previously obtaining the count of light block signals or ejection ratio tolerable to the image to be printed.

The surface smoothing section 104 is disposed at a stage subsequent to the image detector 140 and the printing defect marker 142. This surface smoothing section 104 is situated on the downstream side of the image-recording section 102 in the direction of travel of the recording medium P, and has both a varnish coater 143 which is a clear liquid feeding means that feeds to the surface of the recording medium P an active energy-curable (in this embodiment, UV-curable) liquid (also referred to below as "active energy-curable clear liquid" or simply "clear liquid"), and a UV irradiator 148 which is an active energy-irradiating means that cures the clear liquid by exposing it to active energy.

The varnish coater 143 has a pair of coating rolls 144 and 145 to the surface of which adheres (on which has been impregnated) the clear liquid. The coating rolls 144 and 145 are disposed at positions at which the recording medium P transported by the transport section 110 is nipped. The coating rolls 144 and 145 rotate in accordance (synchronous) with movement of the recording medium P while nipping the recording medium P, thereby coating with a clear liquid, following passage through the image-recording section 102 and image formation, the surface of the recording medium P (the surface on which an image has been formed) after the drawing state has been inspected by the image detector 140 and the print defect marker 142.

The clear liquid coated by the varnish coater 143 is an active energy-curable clear liquid which is curable by exposure to ultraviolet light. Exemplary clear liquids include cationic-polymerizable compositions, radical-polymerizable compositions and aqueous compositions which contain as the primary ingredients at least a polymerizable compound and a photoinitiator. The clear liquid is described in detail later in the specification.

The UV irradiator 148 is disposed on the downstream side of the varnish coater 143 in the direction of travel of the recording medium P. The UV irradiator 148 irradiates the recording medium P with active energy (in this embodiment, ultraviolet light), thereby curing the clear liquid which has been coated onto the surface of the recording medium P and smoothed. The UV irradiator 148 is exemplified by metal halide lamps, high-pressure mercury vapor lamps and ultraviolet LEDs.

The varnish coater 143 and the UV irradiator 148, while not devices critical for smoothing the region of the recording medium P to which foil is to be applied, are preferably provided because a good, smooth surface can be obtained when a clear liquid is applied.

As noted above, in this embodiment, a transport buffer is provided between the surface smoothing section 104 and the subsequently described foil stamping section 106.

By providing such a transport buffer, the slack in the recording medium P that arises from a difference in the transport speeds of the surface smoothing section 104 and the foil stamping section 106 can be absorbed, enabling the labels to be efficiently manufactured.

The foil stamping section 106 is situated on the downstream side of the surface smoothing section 104 in the direction of transport of the recording medium P, and includes a foil feed roll 150, a foil take-up roll 152, a first roller 154, a second roller 156, foil 158, and a hot stamping plate 160.

The foil feed roll 150 and the foil take-up roll 152 are disposed so as to be separated by a specific interval. The first roller 154 and the second roller 156 are arranged in such a way as to be separated by a specific interval, such that a plane defined by the rollers 154 and 156 is parallel to the surface of the recording medium P, and at positions more proximate to the recording medium P than the foil feed roll 150 and the foil take-up roll 152. Moreover, the first roller 154 and the second roller 156 are disposed at positions very close to the recording medium P.

The foil 158 is fed out from the foil feed roll 150, passed around the first roller 154 and the second roller 156, and wound onto the foil take-up roll 152. The foil 158 between the first roller 154 and the second roller 156 is made parallel to the recording medium P.

The hot stamping plate (relief plate) 160 is disposed between the first roller 154 and the second roller 156 at a position facing the recording medium P via the foil 158. The face on the recording medium P side of the hot stamping plate 160 is provided with a relief plate portion 160*a* which is made of a material such as zinc or brass and comes into contact with and foil-stamps the foil 158. In addition, the hot stamping plate 160 has a heater (not shown) which heats the relief plate portion 160*a* and a transfer mechanism which transfers the hot stamping plate 160 in a direction of moving it closer to or farther from the recording medium P.

The hot stamping plate 160 brings the relief plate portion 160*a* in a heated state into contact with and presses it against the recording medium P through the foil 158, thereby heat and pressure bonding the foil 158 onto the recording medium P according to the shape of the relief plate portion 160*a*.

The post-treatment section 108 is disposed on, in the recording medium P travel direction, the downstream side of the image-recording section 102, the surface smoothing section 104 and the foil-stamping section 106. It has a varnish coater 162 and an UV irradiator 164 for coating the image surface with a clear, active energy-curable liquid (in the present embodiment, a clear, UV-curable liquid) and improving the gloss, a die cutter 166 for making label-shaped slits in the recording medium P, and a waste roll 172 for peeling off unnecessary portions of the recording medium P.

The varnish coater 162 is a clear liquid feeding means which feeds an active energy (in this embodiment, ultraviolet light) curable clear liquid (referred to below as "active energy-curable clear liquid" or simply "clear liquid") to the surface of the recording medium P, and which is situated on the downstream side, in the travel direction of the recording medium P, of the hot stamping plate 160 in the foil-stamping section 106.

The varnish coater 162 has a pair of coating rolls to the surface of which adheres (on which has been impregnated) a UV-curable clear liquid, and which rotate in accordance (synchronous) with movement of the recording medium P while nipping the recording medium P, thereby coating the surface of the foil-stamped recording medium P (the side on which an image has been formed) with the UV-curable clear liquid.

Here, the clear liquid coated by the varnish coater 162 is an active energy-curable clear liquid which can be cured by exposure to ultraviolet light. Exemplary clear liquids include cationic-polymerizable compositions, radical-polymerizable compositions and aqueous compositions which contain as the primary ingredients at least a polymerizable compound and a photoinitiator. The clear liquid is described in detail later in the specification.

The UV irradiator 164 is disposed on the downstream side of the varnish coater 162 in the travel direction of the recording medium P. The UV irradiator 164 irradiates the surface of the recording medium P with active energy (in this embodiment, ultraviolet light), thereby curing the UV-curable clear liquid that has been coated onto the surface of the recording medium P.

The UV-curable clear liquid is coated onto the surface of the recording medium P and cured, enabling luster to be imparted to the image side of the recording medium P and making it possible to improve the image quality.

The die cutter 166 makes slits 180*b* of a desired label shape in only the pressure-sensitive adhesive sheet 180 of a printed, web-type recording medium P for printing labels, as shown in FIG. 3. The die cutter 166 is situated on the downstream side of the UV irradiator 164 in the travel direction of the recording medium P, and has a cylinder cutter 168 disposed on the image-forming side of the recording medium P and an anvil roller 170 disposed on the opposite side of the recording medium P from the cylinder cutter 168.

The cylinder cutter 168 is composed of a cylinder 168*a* and a plurality of slitting blades 168*b* which are wound around the cylindrical surface of the cylinder 168*a* and are formed according to the shape and arrangement of the labels.

The die cutter 166, while nipping the recording medium P between the cylinder cutter 168 and the anvil roller 170, undergoes an intermittently rocking rotation which is synchronous with the transport speed of the recording medium P, causing the slitting blades 168*b* to make label-shaped slits in only the pressure-sensitive adhesive sheet 180 of the recording medium P (see FIG. 3).

Figure 4:
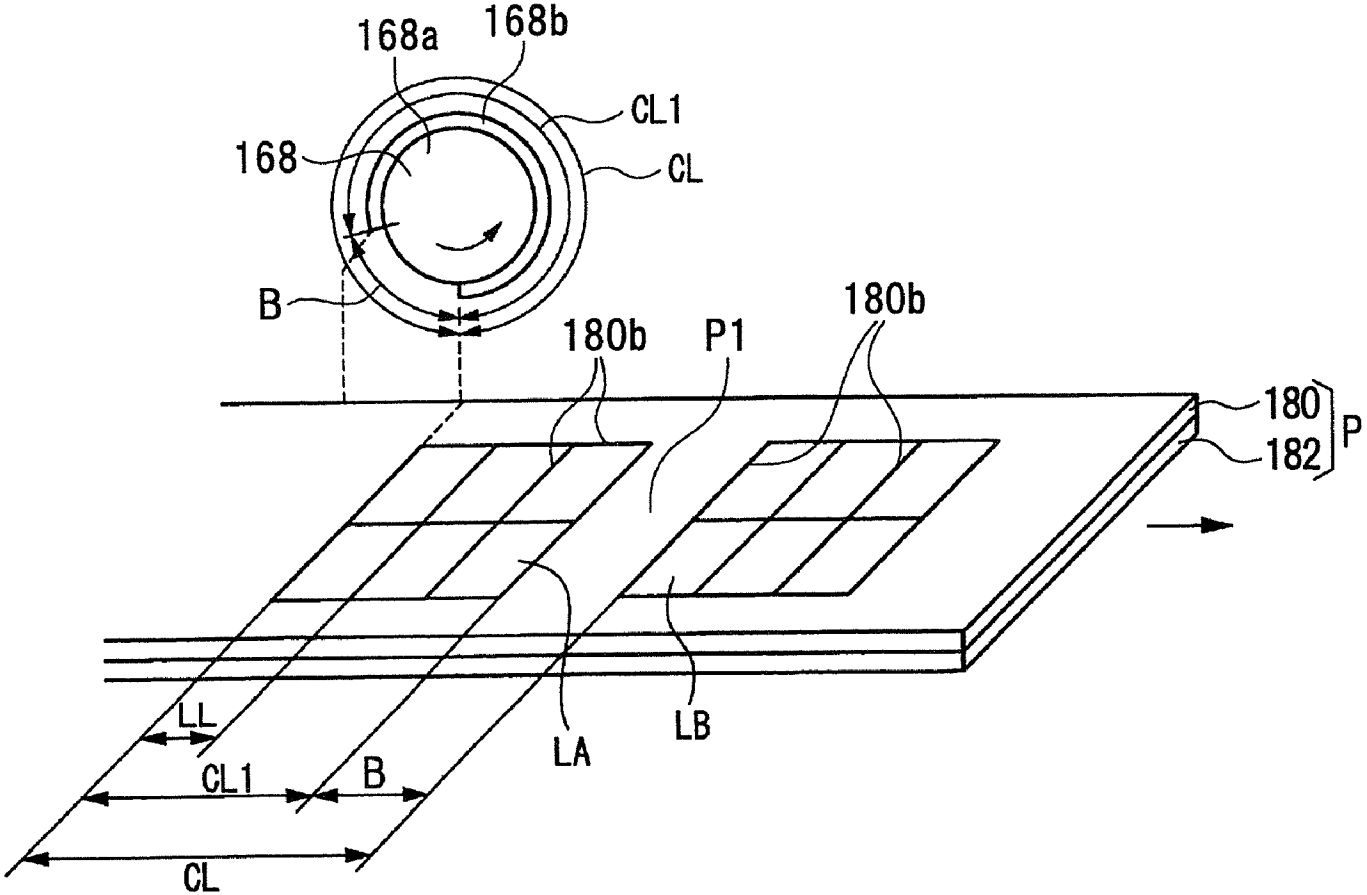
FIG. 4 is a cross-sectional view of a die cutter having slitting blades arranged on a cylindrical surface thereof, and a perspective view showing the condition of slits made in a pressure-sensitive adhesive sheet by continuously rotating the die cutter.

Here, referring to FIG. 4, if the cylindrical surface of the cylinder 168*a* has a length CL in the circumferential direction which is not an integral multiple of the length LL of the labels L, that is, if the length CL in the circumferential direction of the cylindrical surface of the cylinder 168*a* and the length CL1 of the slitting blades 168*b* do not agree, there arises on the cylindrical surface of the cylinder 168*a* a blank portion B where the slitting blades 168*b* cannot be provided.

In this case, when label-shaped slits 180*b* are formed by continuously rotating the die cutter 166, a large unnecessary portion P1 corresponding to the blank portion B ends up being formed between the group of labels LB in which slits 180*b* have been formed during the previous rotation of the die cutter 166 and the group of labels LA in which slits 180*b* have been formed during the present rotation, resulting in the generation of waste in the recording medium P.

Figure 5:
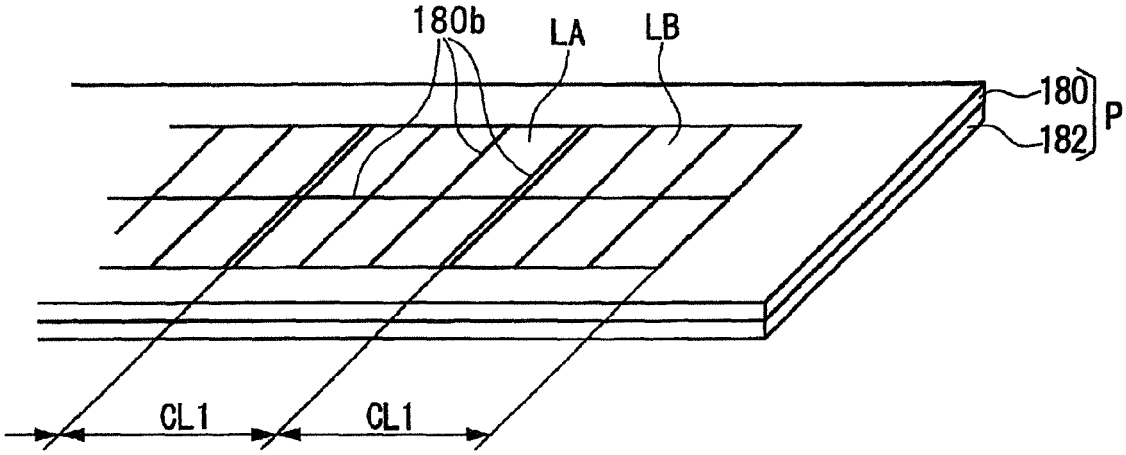
FIG. 5 is a perspective view showing the condition of slits made in a pressure-sensitive adhesive sheet with a die cutter.

In the present embodiment, to eliminate the wasteful formation of unnecessary portions P1 in the recording medium P, the die cutter 166 is made to rotate with an intermittently rocking motion. In this way, as shown in FIG. 5, the next slits 180*b* can be made at the trailing end of the group of labels LB in which the previous slits 180*b* were made. In this way, even when the length CL in the circumferential direction of the cylindrical surface of the cylinder 168*a* is not an integral multiple of the length LL of the labels L, unnecessary portions P1 are not formed between the groups LB and LA of labels L, thus enabling a web-type recording medium P for printing labels to be efficiently used.

The waste roll 172 peels from the peel sheet 182 and takes up unnecessary portions (label borders) of the pressure-sensitive adhesive sheet 180 which do not form labels (finished product) L.

The thus taken up recording medium P after unnecessary portions have been peeled, that is, the recording medium P in a state where only the labels L remain adhering to the peel sheet 182, is then taken up onto the product roll 134, giving the final product.

Next, the control unit 112 which controls the transport section 110, the image-recording section 102, the surface smoothing section 104, the foil-stamping section 106, the post-treatment section 108, the image detector 140 and the print defect marker 142 is described.

As shown in FIG. 2, the control unit 112 has a memory 191 which stores recording image data for ink ejection from the recording heads 136Y, 136C, 136M and 136K of the recording head unit 135, a head drive controller 192 for controlling the drive of the recording heads 136Y, 136C, 136M and 136K of the recording head unit 135 based on the recording image data, an image data analyzer 193 for analyzing the shapes of the labels L based on the image data stored in the memory 191, a transport speed changer 194 for changing the transport speed of the web-type recording medium P for printing labels based on the shapes of the labels L analyzed by the image data analyzer 193, a transport motor controller 195 for controlling the rotational speed of the transport motors 126*a* and 134*a* based on the transport speed changed by the transport speed changer 194, a die cutter controller 196 for controlling the rotational speed of the die cutter 166 based on the transport speed changed by the transport speed changer 194, the image detection controller 197 for comparing the printed image on the label surface that has been read by the image detector 140 with the specified image data, and a marking controller 198 for applying a mark to a label having a printing defect when a label with a printing defect has been detected by the image detection controller 197.

In addition, an input unit 199 such as a computer is connected to the memory 191 of the control unit 112. The memory 191 stores recording image data that has been input from the input unit 199.

The head drive controller 192, based on the image data stored in the memory 191, selects ink droplet-ejection nozzles in the recording heads 136Y, 136C, 136M and 136K of the recording head unit 135, computes the amount of ink droplets to be ejected, the ejection timing and other parameters, and controls the recording head unit 135 based on the computation results. To illustrate, in the case of piezoelectric ink-jet heads such as those in the present embodiment, the piezoelectric element to which a voltage will be applied is selected from among a plurality of ejection portions (nozzles), the voltage to be applied, the period of application and the timing of such application are computed and ejection signals are sent to the recording heads 136Y, 136C, 136M and 136K based on the computation results.

The image data analyzer 193 analyzes the shape of a label L from label edge data among the image data stored in the memory 191, and sends the results of analysis to the transport speed changer 194.

The transport speed changer 194 has pre-stored therein the transport speed optimal to post-treatment for each label L shape. Based on both the shape of the label L computed from the label edge data analyzed by and received from the image data analyzer 193 and the stored transport speed, the transport speed changer 194 computes the optimal transport speed of the recording medium P and sends the computation results to the transport motor controller 195 and the die cutter controller 196.

The transport motor controller 195 controls the rotational speeds of the transport motors 126*a* and 134*a* based on the optimal transport speed computed by the transport speed changer 194. In this way, the web-type recording medium P for printing labels is transported at the optimal speed.

The die cutter controller 196 controls the rotational speed of the die cutter 166 based on the optimal transport speed computed by the transport speed changer 194. Specifically, the die cutter controller 196 controls the rotational speed of the die cutter 166 so that the transport speed of the recording medium P and the circumferential velocity of the slitting blades 168*b* on the die cutter 166 are the same.

The control unit 112 thus changes or regulates, based on label shape data calculated from the label edge data, the transport speed of the recording medium P which is transported through the post-treatment section 108.

In addition, it is preferable for the transport speed changer 194 to control, based on the label L shape data, the transport speed of the recording medium P so as to slow the speed at positions of label portions that are vulnerable to the peeling of unnecessary portions (where the unnecessary portions are likely to be torn when peeled from the peel sheet). This helps prevent tearing or breakage from occurring when the waste is removed, enabling the reliable removal of unnecessary portions other than the label portions.

The conditions under which tearing or breakage tend to occur when unnecessary portions are peeled off differ depending on the material of which the pressure-sensitive adhesive paper is made. For example, tearing or breakage may occur when the width of the unnecessary portions is not more than 5 mm or when such portions have an acute angle of not more than 30°. It is advantageous to set in the transport speed changer 194 optimal peel rates that have been determined beforehand empirically under various conditions and to compute the optimal transport speed of the recording medium P while also taking into account these optimal peel rates.

Next, a method for producing labels with the digital label printer 100 is described. Referring to FIG. 1, the recording medium P that has been let out from the feed roll 122 onto which it is wound into a roll is transported by the transport section 110 to the undercoat-forming section 114 and the image-recording section 102.

The undercoat-forming section 114 forms on the surface of the recording medium P an undercoat that has been cured only at the interior. Next, the recording heads 136Y, 136C, 136M and 136K eject, under control of the control unit 112, droplets of UV-curable ink onto the recording medium P passing positions opposed thereto. The recording medium P onto which the ink has been ejected then travels further and passes positions opposite the UV irradiators 138 and 139, where it is irradiated with ultraviolet light, thereby curing the ink.

That is, when the recording medium P passes positions opposite the recording heads 136Y, 136C, 136M and 136K, ink droplets are ejected onto the recording medium P from the recording heads 136Y, 136C, 136M and 136K. The recording medium P is subsequently exposed to ultraviolet light from the UV irradiators 138 and 139, causing the ink to cure by the process as described above, and thereby forming an image on the surface of the recording medium P.

Next, the image that has been formed on the surface of this recording medium P is read by the image detector 140. Under the control of the image detection controller 197, this data is compared with image data for the specified label printing image which is stored in the image data analyzer 193, and a detection is made in the manner as described above as to whether the image is a defective image with a printing defect, namely, the label has a printing defect.

When the label is detected as having a printing defect as a result of comparison with the image data for the specified label printing image in the image detector 140, the marking controller 198 causes the printing defect marker 142 to place a specific mark indicating a defectively printed product on the label having a printing defect.

The design, size and other attributes of this mark may be set as desired.

The recording medium P on which images have been formed and for which inspection of the printing results has been completed is transported through the transport buffer to the post-treatment section 108, where a UV-curable clear liquid is applied by the varnish coater 162 to the surface of the recording medium P, then is cured by the UV irradiator 164.

The recording medium P that has been coated with the UV-curable clear liquid is transported to the die cutter 166, where slits 180*b* in the shape of labels L are made only in the pressure-sensitive adhesive sheet 180 by means of the cylinder cutter 168 and the anvil roller 170.

At this time, because the die cutter 166, as noted above, makes slits 180*b* in the shape of labels L while intermittently rocking, the slits 180*b* can be continuously formed. Waste from the recording medium P can thus be minimized.

Unnecessary portions (portions other than the labels L) of the pressure-sensitive adhesive sheet 180 of the recording medium P are peeled from the peel sheet 182 and taken up onto the waste roll 172. The recording medium P on which only the labels L remain affixed to the peel sheet 182 is taken up onto the product roll 134, thereby giving a final product.

In some cases, the labels remaining on the recording medium P on which images have been recorded in the image-recording section 102 and the recorded images have been checked may include labels on which marks indicating a defectively printed product have been made as a result of being read by the image detector 140 and compared with image data for a specified label printing image. In such cases, an inspection worker or the like standing by near the product roll 134 will take appropriate action, such as peeling off the label that has been marked to indicate a defectively printed product and affixing at the same position in its place a correctly printed label.

Such an operation, when compared with conventional operations that rely on visual inspection, greatly reduces the burden on inspection personnel, and thus promises to have major practical effects, including the prevention of inspection errors such as overlooking defective goods, and a reduction in the level of fatigue experienced by inspection workers.

Moreover, the digital label printer 100 of the present embodiment carries out peel processing in which the transport speed changer 194, based on label shape data, slows the transport speed of the recording medium P at positions of label portions which are vulnerable to the peeling of unnecessary portions, thereby preventing the tearing or breakage of the labels L during post-treatment (waste removal) and enabling the reliable removal of unnecessary portions other than the label portions. In this way, halting of the device due to the tearing or breakage of labels L is eliminated, enhancing productivity and making it possible to inexpensively provide labels L.

Another embodiment of a digital label printer is described below while referring to FIGS. 6 and 7.

Figure 6:
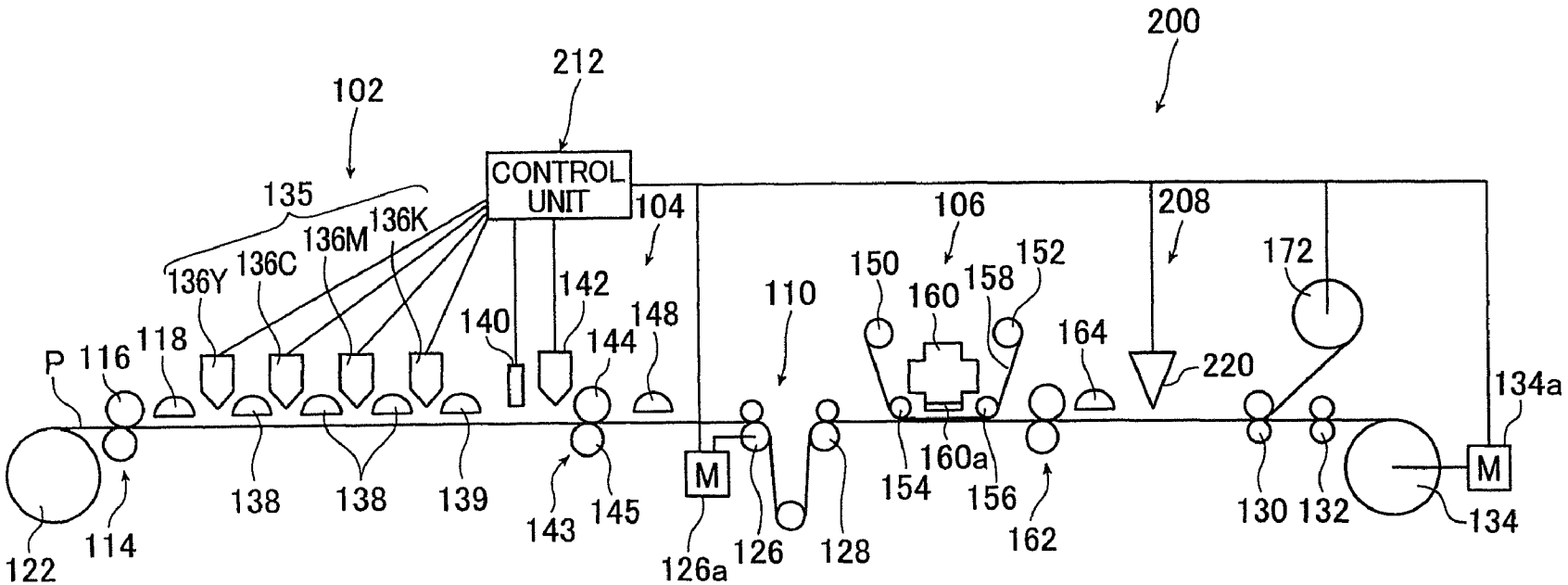
FIG. 6 is a front view showing, in simplified form, another embodiment of a digital label printer of the invention.

FIG. 6 is a front view showing, in simplified form, another embodiment of a digital label printer of the invention that employs an ink-jet recording device which is an example of an image forming device of the invention. FIG. 7 is a block diagram illustrating a control unit for controlling the digital label printer shown in FIG. 6.

A digital label printer 200 shown in FIG. 6 has an arrangement which, aside from a post-treatment section 208, is the same as that of the digital label printer 100 shown in FIG. 1. Like elements in both embodiments are thus denoted by the same reference symbols and repeated explanations of such elements are omitted below. The following description focuses on the distinctive features of the digital label printer 200.

As shown in FIG. 6, the post-treatment section 208 of the digital label printer 200 has a varnish coater 162, a UV irradiator 164, a laser cutter 220, and a waste roll 172. Because the varnish coater 162, the UV irradiator 164 and the waste roll 172 are the same as the varnish coater 162, the UV irradiator 164 and the waste roll 172 in the post-treatment section 108 of the digital label printer 100 shown in FIG. 1, detailed explanations of these elements are omitted below.

The laser cutter 220, like the die cutter 166 of the digital label printer 100 shown in FIG. 1, makes slits 180*b* of a desired label shape in only the pressure-sensitive adhesive sheet 180 of a printed, web-type recording medium P for printing labels. It is situated between the UV irradiator 164 and the waste roll 172.

The laser cutter 220 shines a laser at the traveling web-type recording medium P for printing labels, making label-shaped slits 180*b* in only the pressure-sensitive adhesive sheet 180.

Figure 7:
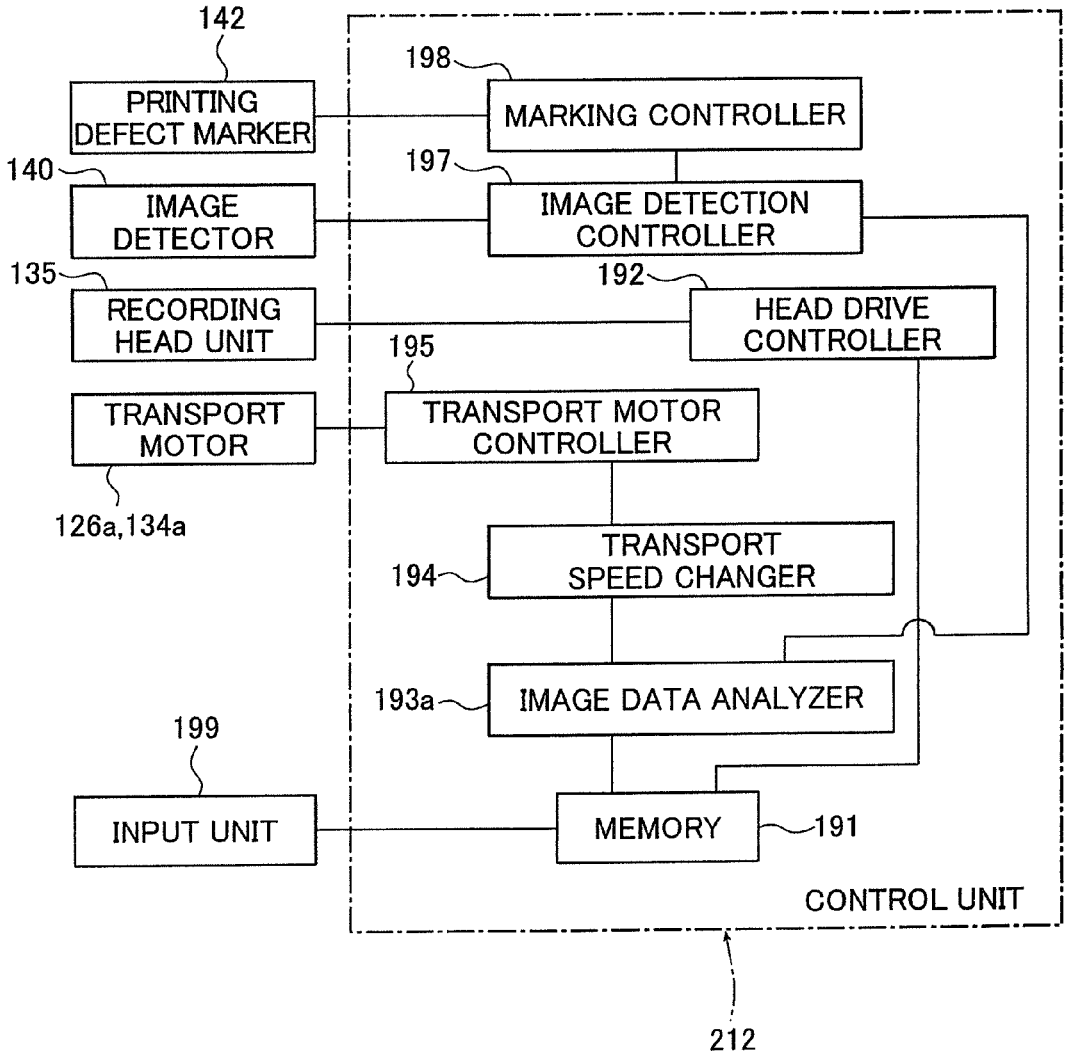
FIG. 7 is a block diagram illustrating a controller for controlling the digital label printer shown in FIG. 6.

As shown in FIG. 7, a control unit 212 has a memory 191 which holds recording image data for ink ejection from recording heads 136Y, 136C, 136M and 136K of a recording head unit 135, a head drive controller 192 which sends the image data to be recorded to the recording heads 136Y, 136C, 136M and 136K of the recording head unit 135, an image data analyzer 193*a* which analyzes the image densities and shapes of the labels L, a transport speed changer 194 which changes the transport speed of the recording medium P based on the shapes of the labels L analyzed by the image data analyzer 193*a*, a transport motor controller 195 which controls the rotational speed of transport motors 126*a* and 134*a* based on the transport speed changed by the transport speed changer 194, an image detection controller 197 which compares the printed image on the label surface that has been read by the image detector 140 with the specified image data, and a marking controller 198 which, when a label with a printing defect has been detected by the image detection controller 197, applies a mark to the label having a printing defect. Hence, the control unit 212 in the present embodiment, aside from differing somewhat in the function of the image data analyzer 193*a* and having no die cutter controller 196, is of substantially the same construction as the control unit 112 shown in FIG. 2.

The transport speed changer 194 of the control unit 212 in this embodiment computes the transport speed of the recording medium P in accordance with the density in the image density data for the label edges to be cut by the laser cutter 220.

That is, the transport speed changer 194, which has previously stored therein the optimal post-treatment transport speeds for image densities, computes the optimal transport speed based on both the label edge image density that has been analyzed by the image data analyzer 193*a* and received therefrom and on the transport speeds stored in memory, then sends the computation results to the transport motor controller 195.

Specifically, control is effected so as to slow the transport speed of the recording medium P at positions in the label edge where the image density is high. In this way, in places where the image density is high, that is, where the label L has a high thickness, and which are thus difficult to cut through with a laser, slowing the transport speed allows more energy to be applied, enabling label-shaped slits 180*b* to be made in the pressure-sensitive adhesive sheet 180.

Here, at the transport speed changer 194, the conditions for setting the transport speed are not limited to the image density (i.e., the ink film thickness). For example, various other properties of the materials, such as the laser light-absorbing properties of the ink, may also be taken into account. The optimal transport speed may be determined empirically in advance for various conditions and set in the transport speed changer 194.

The transport motor controller 195 controls the rotational speed of the transport motors 126*a* and 134*a* based on the transport speeds that have been changed by the transport speed changer 194. Here, the web-type recording medium P for printing labels is transported at an optimal speed.

Next, a method for producing labels using this digital label printer 200 is described. Image formation in an image-recording section 102 on the surface of the recording medium P that has been let out from a feed roll 122 is carried out in the same way as in the above-described digital label printer 100.

The recording medium P on which an image has been formed passes through a transport buffer and is transported to the post-treatment section 208, where a UV-curable clear liquid is coated onto the surface of the recording medium P using the varnish coater 162, then cured using the UV irradiator 164.

The recording medium P on which the UV-curable clear liquid has been coated is transported to the laser cutter 220, where it is irradiated with a laser so as to form slits 180*b* in the shape of labels L only in the pressure-sensitive adhesive sheet 180.

Next, unnecessary portions (portions other than the labels L) of the pressure-sensitive adhesive sheet 180 of the recording medium P are peeled from the peel sheet 182 and taken up by the waste roll 172. The recording medium P on which only the labels L remain affixed to the peel sheet 182 is wound onto a product roll 134, thereby giving a final product.

Here, in laser cutting, it is necessary to increase the energy in accordance with the thickness of the label L. The thicker the label L, the more energy is required.

When an active energy-curable ink is used, the cured ink that is formed on the pressure-sensitive adhesive sheet 180 swells outward. The swell height of the cured ink may be, for example, about 12 μm. In a color printed area where a plurality of inks (Y, M, C) are deposited on top of each other, this height becomes even greater. When active energy-curable ink is employed, because recording media P which do not absorb any ink whatsoever are commonly employed, the swell height may increase even further. Also, in areas of high image density, a large amount of ink is deposited. Hence, the swell height also increases, resulting in an even greater thickness. The minimum thickness of a recording medium P for printing labels is about 12 μm, which is thinner even than the ink thickness, further increasing the influence of the ink thickness.

The digital label printer 200 of the present embodiment deals with this problem in the post-treatment step by using the transport speed changer 194, which adjusts the transport speed of the recording medium P in accordance with the density in the image density data at the label edges; specifically, slows the transport speed of the recording medium P when cutting thick areas with the laser. By cutting areas where the image density is high and the ink such as active energy-curable ink has a high thickness at a slow speed with the laser cutter 220, slits can be reliably made in only the pressure-sensitive adhesive sheet and locally incomplete cuts can be prevented from occurring.

Because the detection of defectively printed labels and the marking treatment carried out on such labels in the present embodiment are carried out in exactly the same way as in the earlier described embodiment, a description of these steps is omitted here.

Next, a further example of the digital label printer is described below in conjunction with FIG. 8.

Figure 8:
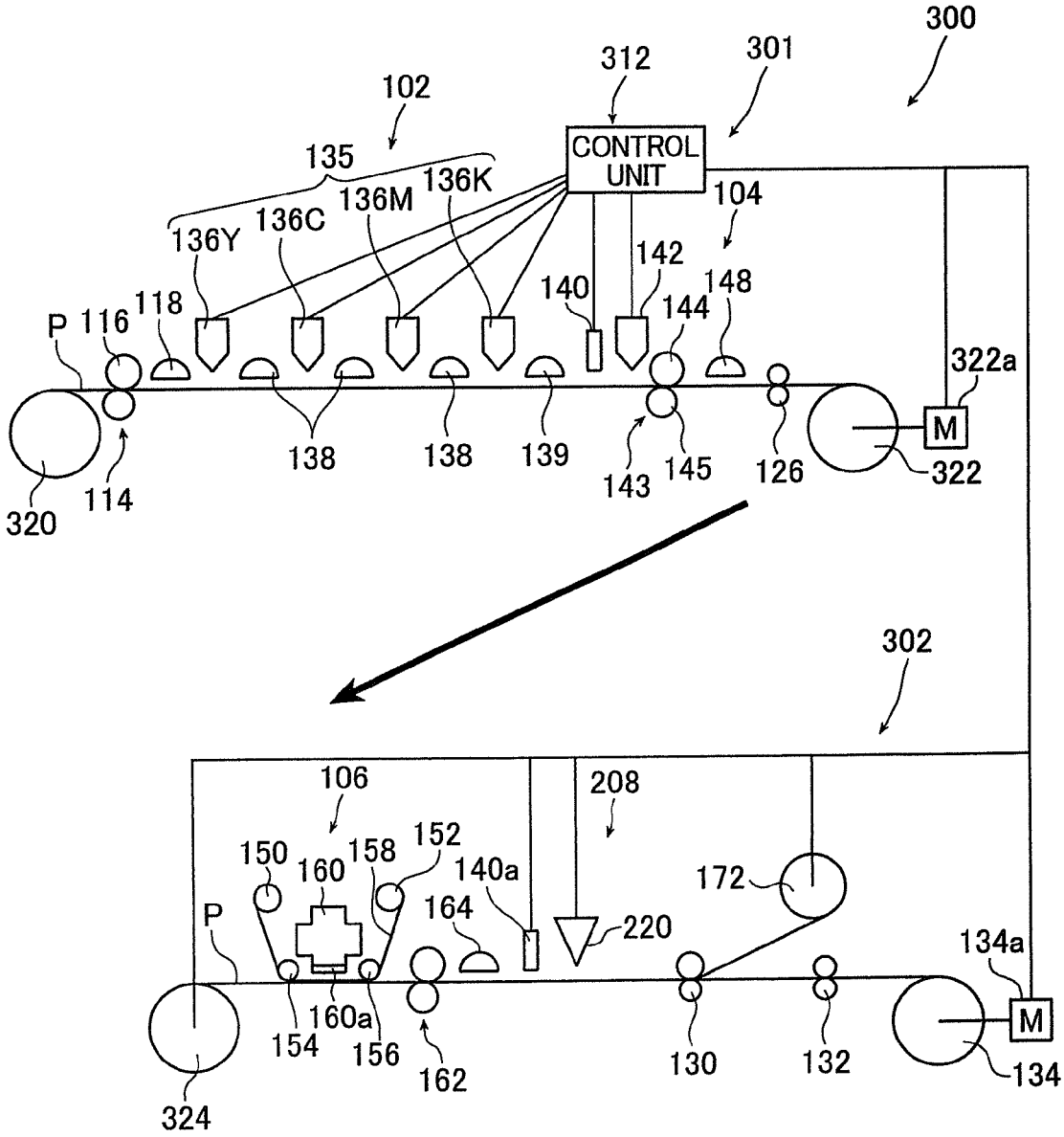
FIG. 8 is a front view showing, in simplified form, yet another embodiment of a digital label printer of the invention.

FIG. 8 is a front view showing, in simplified form, a yet another embodiment of a digital label printer of the invention that uses an ink-jet recording device which is an example of the image forming device of the invention.

In a digital label printer 300 shown in FIG. 8, the configuration of the respective sections, aside from an image-recording section 102 being integrated with a surface smoothing section 104 and a foil-stamping section 106 being integrated with a post-treatment section 208—each of the resulting integrated units being furnished as independent and discrete device, is substantially the same as that of the digital label printer 200 shown in FIG. 6. Like elements in both embodiments are thus denoted by the same reference symbols and repeated explanations of such elements are omitted below. The following description focuses on the distinctive features of the present digital label printer 300.

As shown in FIG. 8, the digital label printer 300 has a front-end processing unit 301 which includes the image-recording section 102 and the surface smoothing section 104, and a back-end processing unit 302 which includes the foil-stamping section 106 and the post-treatment section 208.

A method for producing labels using the digital label printer 300 and the elements distinctive of the present digital label printer 300 are described below.

The recording medium P is set on a first feed roll 320 in the front-end processing unit 301, and is transported to an undercoat-forming section 114 and the image-recording section 102 by a pair of transport rollers 126. The undercoat-forming section 114 forms on the surface of the recording medium P un undercoat that has been cured only at the interior. Next, using recording heads 136Y, 136C, 136M and 136K and UV irradiators 138 and 139, an image is formed on the surface of the recording medium P that has been transported to the image-recording section 102. The recording medium P on which the image has been formed is taken up onto a collecting roll 322. In the present embodiment, a transport motor 322*a* is provided for the collecting roll 322 so that the collecting roll 322 serves as a drive roller.

The recording medium P on which the image has been formed, i.e., the recording medium P that has been taken up onto the collecting roll 322, is then set on a second feed roll 324 in the back-end processing unit 302. The recording medium P that has been set on the second feed roll 324 is transported by transport roller pairs 130 and 132 to the back-end processing unit 302.

The recording medium P on which the image has been formed has a UV-curable clear liquid applied thereto with a varnish coater 162, following which the recording medium P is irradiated with ultraviolet light at a UV irradiator 164, thereby curing the UV-curable clear liquid that has been applied.

Next, the recording medium P passes by a laser cutter 220 where slits 180*b* corresponding to the shape of the labels L are made in only the pressure-sensitive adhesive sheet 180 by the laser cutter 220, after which unnecessary portions of the pressure-sensitive adhesive sheet 180 of the recording medium P are peeled from the peel sheet 182 and wound onto a waste roll 172. At the same time, the recording medium P from which the unnecessary portions have been removed so as to leave only the label portions of the pressure-sensitive adhesive sheet 180 and the peel sheet 182, is wound onto a product roll 134, thereby giving a finished product.

In this embodiment as well, a transport speed changer 194 computes the optimal transport speed based on the label edge image density analyzed by an image data analyzer 193*a*. A transport motor controller 195 controls the rotational speed of a transport motor 134*a* to the optimal transport speed that has been computed, and carries out transport of the recording medium P. That is, when the laser cutter 220 is used to cut areas where the label edges have a high image density, the transport motor controller 195 carries out control that slows the transport speed of the recording medium P.

In this way, by configuring the digital label printer as separate front-end and back-end processing units, the front-end processing steps of printing the labels L and smoothing the image surfaces, and the back-end processing steps of foil-stamping, clear liquid coating (glossy surface formation), slitting and waste removal can be carried out as separate operations, enabling the back-end processing of numerous different types of labels L to be carried out collectively.

The time required for printing is generally longer than the time required for waste removal and other back-end processing steps. Hence, a single back-end processing unit 302 is able to handle the output from a plurality of front-end processing units 301, making efficient processing possible.

Even in cases where the units are separated in this way, by controlling the transport speed in accordance with values obtained by computation based on image data, the labels formed on the pressure-sensitive adhesive sheet 180 can be precisely cut away from the surrounding unnecessary portions.

Although not shown, in this embodiment as well, as in the embodiment shown in FIG. 7, the control unit has a memory 191 which holds recording image data for ink ejection from the recording heads 136Y, 136C, 136M and 136K of a recording head unit 135, a head drive controller 192 which sends the image data to be recorded to the recording heads 136Y, 136C, 136M and 136K of the recording head unit 135, the image data analyzer 193*a* which analyzes the image densities and shapes of the labels L, the transport speed changer 194 which changes the transport speed of the recording medium P based on the shapes of the labels L analyzed by the image data analyzer 193*a*, the transport motor controller 195 which controls the rotational speed of the transport motors 322*a* and 134*a* based on the transport speed changed by the transport speed changer 194, an image detection controller 197 which compares the printed image on the label surface that has been read by the image detector 140 with the specified image data, and a marking controller 198 which, when a label with a printing defect has been detected by the image detection controller 197, applies a mark to the label having a printing defect.

Because the operation in which marks are applied to defectively printed labels is carried out in exactly the same way as in the other embodiments described above, an explanation of this operation is omitted here.

Figure 9:
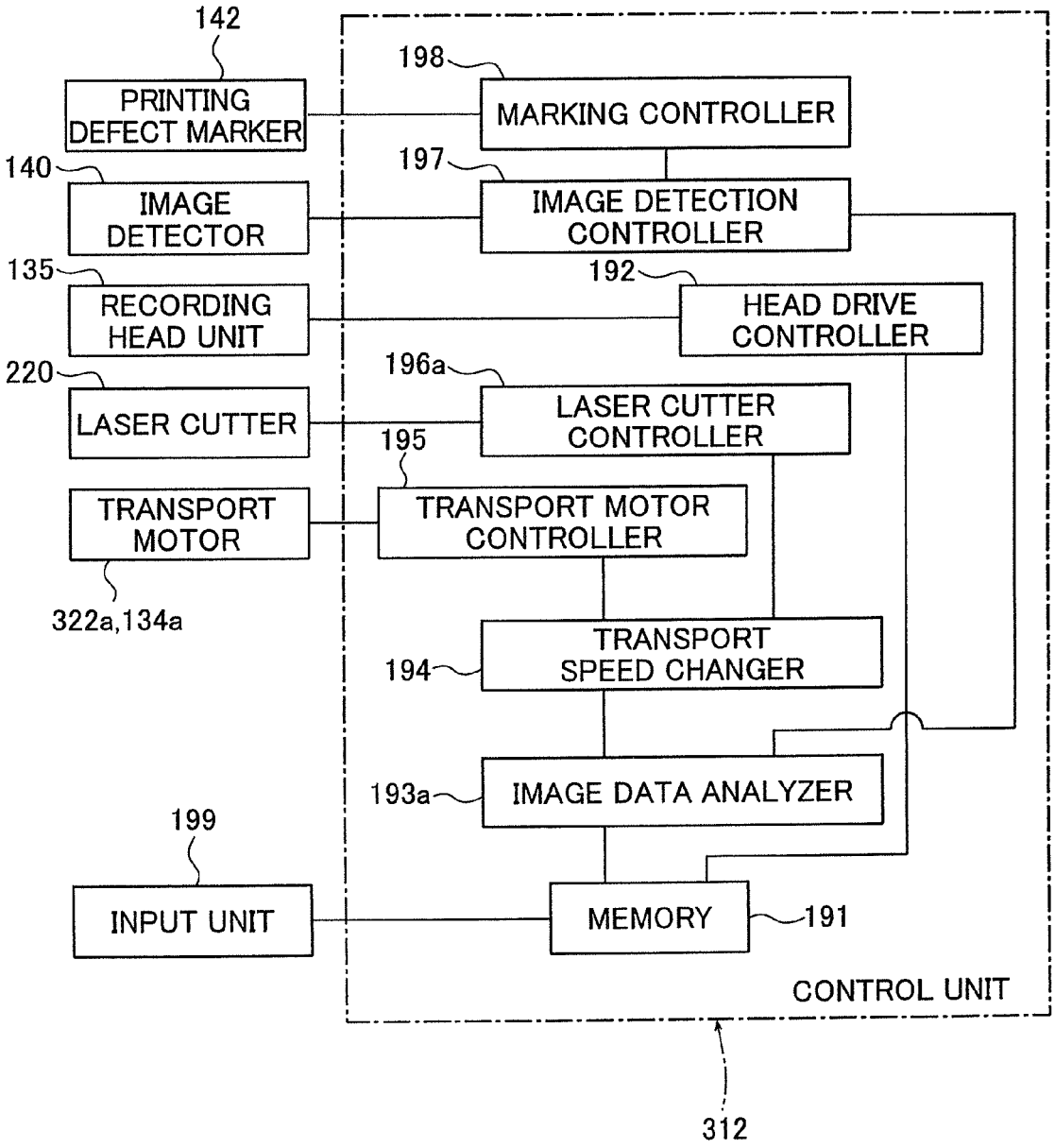
FIG. 9 is a block diagram illustrating a control unit for controlling the digital label printer shown in FIG. 8.

In still another embodiment, as shown in FIG. 9, instead of the die cutter controller 196 which controls the rotational speed of the die cutter 166 based on the transport speed changed by the transport speed changer 194 in the control unit 112 shown in FIG. 2, there is provided a laser cutter controller 196*a* which controls the laser output of the laser cutter 220 based on the label L image analyzed by the image data analyzer 193*a*.

The operation of this embodiment differs somewhat from that of the other embodiments described above. As in the above embodiments, marks are applied to labels having printing defects by the marking controller 198 when the image detection controller 197 has detected a defectively printed label after comparing the printed image on a label surface read by the image detector 140 with the specified image data. In the control unit 312 of the present embodiment, the marks are detected by an image detector 140*a* which is additionally disposed prior to the laser cutter 220, and control is carried out by the laser cutter controller 196*a* so as not to operate the laser cutter 220 for the defectively printed labels.

Hence, in this embodiment, when unnecessary portions of the pressure-sensitive adhesive sheet of the recording medium P are peeled from the peel sheet 182 and taken up onto the waste roll 172, because slits have not been made in the defectively printed labels, these too are peeled off and removed together with the unnecessary portions, as a result of which the positions where the defectively printed labels were located become blank regions. Therefore, when an inspection worker at this station finds a defectively printed label, there is no need for the worker to peel off the defective label. All that needs to be done is to affix a correctly printed label in the blank region.

In this embodiment, the digital label printer has been described as a UV-curable ink-jet head label printer. However, the invention is not limited to this. Similar effects may be achieved using any type of printer.

Common paper such as uncoated paper and coated paper, various non-absorbing resin materials employed in so-called soft packaging and resin films made thereof may be used as the recording medium without any particular limitation. Illustrative examples of such plastic films include PET films, OPS films, OPP films, ONy films, PVC films, PE films and TAC films. Other plastics that may be used as the recording medium material include polycarbonates, acrylic resins, ABS, polyacetals, PVA and rubbers. Use may also be made of metals and glass. A printing plate may also be formed by using a surface-treated support serving as the substrate of the printing plate for the recording medium and forming an image on the surface of the support with a material having ink repellency.

Materials having less heat shrinkage upon curing are excellent in adhesion between the cured ink composition and the recording medium, so selection of such materials have an advantage of formation of high-definition images even in films which are likely to curl or deform, as exemplified by thermally shrinkable films such as PET films, OPS films, OPP films, ONy films and PVC films.

Also, in the present embodiment, UV-curable ink and UV-curable clear liquid were used as the undercoat liquid, ink and clear liquid, and an ultraviolet light source was used as the light source for curing the undercoat liquid, ink and clear liquid. However, the invention is not limited to these alone. Various types of active energy-curable undercoat liquids, inks and clear liquids may be used for the undercoat liquid, ink and clear liquid. Similarly, any light source which applies active energy may be used as the light source for curing the undercoat liquid, ink and clear liquid.

As used herein, "active energy" is not subject to any particular limitation, provided the irradiation thereof is capable of conferring energy which may generate initiating species in the undercoat liquid, ink and clear liquid, and thus broadly encompasses, for example, alpha rays, gamma rays, x-rays, ultraviolet light, visible light and electron beams. Of these, from the standpoint of cure sensitivity and the ready availability of the equipment, ultraviolet light and electron beams are preferred. Ultraviolet light is especially preferred. Accordingly, the active energy-curable undercoat liquids, active energy-curable inks and active energy-curable clear liquids are preferably undercoat liquids, inks and clear liquids which are curable by exposure to ultraviolet light.

Active energy-curable undercoat liquids, inks and clear liquids which may be advantageously used in the ink-jet recording devices that employ active energy-curable ink as in the above-described embodiments, and the active energy which cures the undercoat liquids and inks are described below in detail. Because active energy-curable clear liquids, aside from containing no colorant, are identical to active energy-curable inks, the following description relates for the most part to active energy-curable inks.

The peak wavelength of the active energy, which depends on the absorption characteristics of the sensitizing dye within the ink (the ink is also referred to below as the "ink composition"), is suitably in a range of, for example, 200 to 650 nm, preferably 300 to 450 nm, and more preferably 350 to 450 nm. In addition, the electron transfer initiation system in the ink used in the invention has a sufficient sensitivity even to low-output active energy. It is therefore appropriate for the active energy output to be for example up to 2,000 mJ/cm$^2$, preferably from 10 to 2,000 mJ/cm$^2$, more preferably from 20 to 1,000 mJ/cm$^2$, and even more preferably from 50 to 800 J/cm$^2$. Moreover, it is suitable for the active energy to have an exposure face illuminance (maximum illuminance at surface of recording medium) of, for example, from 10 to 2,000 mW/cm$^2$, and preferably from 20 to 1,000 mW/cm$^2$.

In particular, in the ink-jet recording device used in the invention, it is preferable for the active energy to have a light-emitting wavelength peak of from 390 to 420 nm and be irradiated from a light-emitting diode which generates ultraviolet light having a maximum illuminance at the surface of the above-described recording medium of from 10 to 1,000 mW/cm$^2$.

In the ink-jet image-recording device used in the invention, it is suitable for the active energy to be irradiated onto the ink composition which has been ejected onto the recording medium for a period of from 0.01 to 120 seconds, and preferably from 0.1 to 90 seconds.

Also, in the ink-jet recording device used in the invention, it is advantageous to warm the ink to a given temperature and also to set the length of time from deposition of the ink on the recording medium until exposure to active energy at from 0.01 to 0.5 second, preferably from 0.02 to 0.3 second, and more preferably from 0.03 to 0.15 second. By thus controlling the length of time from deposition of the ink onto the recording medium until exposure to active energy to a very brief period of time, it is possible to prevent the deposited ink from bleeding before it cures.

To obtain a color image using the ink-jet recording device of the invention, it is preferable to superimpose the inks in the order of increasing brightness. By superimposing the inks in this way, the active energy will more readily reach the ink at the bottom, which should make it possible to achieve a good cure sensitivity, a reduction in residual monomer, a reduction in odor, and improved adhesion. Alternatively, irradiation of the active energy may be carried out by exposing the colors at the same time after they have all been ejected, although exposure of the ink for each color is preferable from the standpoint of promoting curing.

Moreover, with active energy-curable inks, it is desirable that the ink to be ejected be set to a fixed temperature as explained above, so it is preferable to employ insulation and warming to carry out temperature control from the ink feed tanks to the recording heads (ink-jet heads). It is preferable for a recording head unit which is heated to be thermally shielded or insulated so that the device is not subject to temperature influences from ambient air. To shorten the printer startup time required for heating or reduce the loss of thermal energy, it is preferable to carry out thermal insulation with respect to other sites and also to give the heating unit overall a small heat capacity.

The active energy sources primarily used include mercury vapor lamps, gas lasers and solid state lasers. Mercury vapor lamps and metal halide lamps are widely used as UV irradiators for curing UV-curable inks. In addition, the substitution of GaN semiconductor-based ultraviolet light-emitting devices for the above-mentioned sources is highly useful both industrially and for the environment. Moreover, because LEDs (UV-LEDs) and LDs (UV-LDs) are small, long-lived, highly efficient and inexpensive, they can be advantageously used as active energy-curable ink-jet irradiation sources (active ray sources).

As noted above, it is also possible to use light-emitting diodes (LEDs) and laser diodes (LDs) as active energy sources. In particular, when a UV source is required, use can be made of ultraviolet LEDs and ultraviolet LDs. For example, Nichia Corporation has marketed a violet LED with a primary emission spectrum having wavelengths between 365 nm and 420 nm. Moreover, when even shorter wavelengths are required, U.S. Pat. No. 6,084,250 discloses an LED capable of emitting active energy that has been centered between 300 nm and 370 nm. Other ultraviolet LEDs are available as well, enabling exposure to be carried out using irradiation from different ultraviolet bands. One type of active energy source that is highly desirable for use in the present invention is the UV-LED. UV-LEDs having a peak wavelength of from 350 to 420 nm are especially preferred.

The various ingredients employed in the active energy-curable inks that may be suitably used to work the invention are described below.

Active energy-curable inks which may be advantageously used in the invention include cationic-polymerizable ink compositions, radical-polymerizable ink compositions and aqueous ink compositions. These compositions are described below in detail.

(Cationic-polymerizable Ink Composition)

The cationic-polymerizable ink composition comprises (a) a cationic-polymerizable compound, (b) a compound which generates an acid upon exposure to active energy and (c) a colorant. The cationic-polymerizable ink composition may optionally further comprise a ultraviolet absorber, a sensitizer, an antioxidant, a discoloration inhibitor, a conductive salt, a solvent, a polymer compound and a surfactant.

The various components constituting the cationic-polymerizable ink composition are sequentially described below.

((a) Cationic-polymerizable Compound)

The cationic-polymerizable compound (a) to be used in the active energy-curable ink is not specifically limited so far as it is a compound which undergoes polymerization reaction with an acid generated by the compound (b) to be described later which generates the acid upon exposure to active energy to thereby cause curing. Various cationic-polymerizable monomers known as cationic photopolymerizable monomers may be used for such a compound. Exemplary cationic-polymerizable monomers include epoxy compounds, vinyl ether compounds and oxetane compounds disclosed in JP 6-9714 A, JP 2001-31892 A, JP 2001-40068 A, JP 2001-55507 A, JP 2001-310938 A, JP 2001-310937 A, and JP 2001-220526 A.

Exemplary epoxy compounds include an aromatic epoxide, an alicyclic epoxide and an aliphatic epoxide.

A di-or polyglycidyl ether produced by the reaction of a polyvalent phenol having at least one aromatic nucleus or alkylene oxide adduct thereof with epichlorohydrin may be used for the aromatic epoxide. Examples of the di-or polyglycidyl ether include di-or polyglycidyl ether of bisphenol A or alkylene oxide adduct thereof, di-or polyglycidyl ether of hydrogenated bisphenol A or alkylene oxide adduct thereof, and novolac epoxy resin. Examples of the alkylene oxide include ethylene oxide, and propylene oxide.

An example of the alicyclic epoxide that may be preferably used include a cyclohexene oxide-or cyclopentene oxide-containing compound obtained by epoxidizing a compound having at least one cycloalkane ring such as cyclohexene or cyclopentene ring with a proper oxidizing agent such as hydrogen peroxide and peracid.

A di-or polyglycidyl ether of an aliphatic polyhydric alcohol or alkylene oxide adduct thereof may be used for the aliphatic epoxide. Representative examples of the di-or polyglycidyl ether include diglycidyl ethers of alkylene glycols such as diglycidyl ether of ethylene glycol, diglycidyl ether of propylene glycol and diglycidyl ether of 1,6-hexanediol; polyglycidyl ethers of polyhydric alcohols such as di-or triglycidyl ether of glycerin or alkylene oxide adduct thereof; and diglycidyl ethers of polyalkylene glycols such as diglycidyl ether of polyethylene glycol or alkylene oxide adduct thereof and diglycidyl ether of polypropylene glycol or alkylene oxide adduct thereof. Examples of the alkylene oxide include ethylene oxide and propylene oxide.

The epoxy compounds may be monofunctional or polyfunctional.

Examples of the monofunctional epoxy compound that may be suitably used for the active energy-curable ink include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monoxide, 1,2-epoxydodecane, epichlorohydrin, 1,2-epoxydecane, styrene oxide, cyclohexene oxide, 3-methacryloyloxymethylcyclohexene oxide, 3-acryloyloxymethylcyclohexene oxide, and 3-vinylcyclohexene oxide.

Examples of the polyfunctional epoxy compound include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolac resin, hydrogenated bisphenol A diglycidyl ether, hydrogenated bisphenol F diglycidyl ether, hydrogenated bisphenol S diglycidyl ether, 3,4-epoxycyclohexylmethyl-3',4'-epoxycyclohexane carboxylate, 2-(3,4-epoxycyclohexyl-5,5-spiro-3,4-epoxy)cyclohexane-meta-dioxane, bis(3,4-epoxycyclohexylmethyl)adipate, vinylcyclohexene oxide, 4-vinylepoxycyclohexane, bis(3,4-epoxy-6-methylcyclohexyl)adipate, 3,4-epoxy-6-methylcyclohexyl-3',4'-epoxy-6'-methylcyclohexane carboxylate, methylene bis(3,4-epoxycyclohexane), dicyclopentadiene diepoxide, di(3,4-epoxycyclohexylmethyl)ether of ethylene glycol, ethylene bis(3,4-epoxy cyclohexanecarboxylate), dioctyl epoxyhexahydrophthalate, di-2-ethylhexyl epoxyhexahydrophthalate, 1,4-butanediol diglycidyl ether, 1,6-hexanediol diglycidyl ether, glycerin triglycidyl ether, trimethylolpropane triglycidyl ether, polyethylene glycol diglycidyl ether, polypropylene glycol diglycidyl ether, 1,1,3-tetradecadiene dioxide, limonene dioxide, 1,2,7,8-diepoxyoctane, and 1,2,5,6-diepoxycyclooctane.

Preferred among these epoxy compounds are aromatic epoxides and alicyclic epoxides in terms of their high curing rate. Particularly preferred among these epoxy compounds are alicyclic epoxides.

Exemplary vinyl ether compounds include di-or trivinyl ether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and monovinyl ether compounds such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecylvinyl ether, diethylene glycol monovinyl ether and octadecylvinyl ether.

The vinyl ether compounds may be monofunctional or polyfunctional.

Specific examples of the monofunctional vinyl ether include methyl vinyl ether, ethyl vinyl ether, propyl vinyl ether, n-butyl vinyl ether, t-butyl vinyl ether, 2-ethylhexyl vinyl ether, n-nonyl vinyl ether, lauryl vinyl ether, cyclohexyl vinyl ether, cyclohexyl methyl vinyl ether, 4-methylcyclohexyl methyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxy polyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethyl cyclohexyl methyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether, and phenoxy polyethylene glycol vinyl ether.

Examples of the polyfunctional vinyl ether include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether and bisphenol F alkylene oxide divinyl ether; and polyfunctional vinyl ethers such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythtritol hexavinyl ether, ethylene oxide adduct of trimethylolpropane trivinyl ether, propylene oxide adduct of trimethylolpropane trivinyl ether, ethylene oxide adduct of ditrimethylolpropane tetravinyl ether, propylene oxide adduct of ditrimethylolpropane tetravinyl ether, ethylene oxide adduct of pentaerythritol tetravinyl ether, propylene oxide adduct of pentaerythritol tetravinyl ether, ethylene oxide adduct of dipentaerythritol hexavinyl ether, and propylene oxide adduct of dipentaerythritol hexavinyl ether.

Preferred among these vinyl ether compounds are di-or trivinyl ether compounds from the standpoint of curability, adhesion to recording medium and surface hardness of image formed. Particularly preferred among these vinyl ether compounds are divinyl ether compounds.

The oxetane compound of the invention is a compound having an oxetane ring. Known oxetane compounds as disclosed in JP 2001-220526 A, JP 2001-310937 A and JP 2003-341217 A can be arbitrarily selected and used.

A compound having from 1 to 4 oxetane rings is preferably used as the oxetane ring-containing compound. The use of such a compound facilitates keeping the viscosity of the ink composition within such a range that the ink composition can be fairly handled and enables a high adhesion to be obtained between the ink composition thus cured and the recording medium.

For the details of the compound having an oxetane ring, reference may be made to the above cited JP 2003-341217 A, paragraphs [0021] to [0084]. The compounds disclosed therein may also be advantageously used in the invention.

Preferred among the oxetane compounds to be used in the invention are those having one oxetane ring from the standpoint of viscosity and adhesion of ink.

These cationic-polymerizable compounds may be used singly or in combination of two or more in the active energy-curable ink. From the standpoint of effectiveness in the inhibition of shrinkage during ink curing, however, at least one compound selected from the group consisting of oxetane compounds and epoxy compounds and a vinyl ether compound are preferably used in combination.

The content of the cationic-polymerizable compound (a) in the ink is preferably from 10% to 95% by weight, more preferably from 30% to 90% by weight, even more preferably from 50% to 85% by weight based on the total solid content of the composition.

((b) Compound which Generates an Acid Upon Exposure to Active Energy)

The active energy-curable ink that may be used in the invention contains a compound which generates an acid upon exposure to active energy (hereinafter optionally referred to as "photoacid generator").

As the photoacid generator to be used in the invention there may be properly selected cationic photopolymerization initiator, radical photopolymerization initiator, photodecolorant for dyes, photodiscolorant, or a compound which generates an acid when irradiated with light used for microresist (ultraviolet ray having a wavelength of from 200 nm to 400 nm, far ultraviolet ray, particularly preferably g-line, h-line, i-line, KrF excimer laser beam), ArF excimer laser beam, electron beam, X-ray, molecular beam or ion beam.

Examples of the photoacid generator include onium salts such as diazonium salt, ammonium salt, phosphonium salt, iodonium salt, sulfonium salt, selenonium salt and arsonium salt, organic halogen compounds and organic metal/organic halogen compounds which undergo decomposition and generate an acid on exposure to active energy, photoacid generators having o-nitrobenzyl type protective group, compounds which undergo photodecomposition to sulfonic acid such as iminosulfonate, disulfone compounds, diazoketosulfone, and diazodisulfone compounds.

Oxazole derivatives and s-triazine derivatives disclosed in JP 2002-122994 A, paragraphs [0029] to [0030] are also advantageously used photoacid generators. Further, onium salt compounds and sulfonate compounds illustrated in JP 2002-122994 A, paragraphs [0037] to [0063] may also be advantageously used for the photoacid generator.

These photoacid generators (b) may be used singly or in combination of two or more thereof.

The content of the photoacid generator (b) in the ink composition is preferably from 0.1 to 20% by weight, more preferably from 0.5 to 10% by weight, even more preferably from 1 to 7% by weight based on the total solid content of the ink composition.

((c) Colorant)

Addition of a colorant to the active energy-curable ink enables a visible image to be formed. It is not always necessary to add a colorant, for example, in the case of forming image areas in a lithographic printing plate, but use of a colorant is also preferable from the viewpoint of the suitability for plate inspection.

The colorant that may be used herein is not specifically limited. Any known coloring materials (pigment, dye) may be properly selected and used depending on the purpose. For example, in order to form an image excellent in weather resistance, pigments are preferably used. The dye used may be a water-soluble dye or an oil-soluble dye. However, an oil-soluble dye is preferred.

(Pigment)

Pigments which are preferably used in the active energy-curable ink are described below.

The pigments to be used in the invention are not specifically limited. A dispersion of any commercially available organic or inorganic pigment in an insoluble resin as a dispersion medium or a pigment grafted with a resin at its surface may be used. Alternatively, a particulate resin dyed with a dye may be used.

Examples of these pigments include those disclosed in Seishiro Ito, "Ganryo no Jiten (Dictionary of Pigments)", 2000, W. Herbst, K. Hunger, "Industrial Organic Pigments", JP 2002-12607 A, JP 2002-188025 A, JP 2003-26978 A, and JP 2003-342503 A.

Now referring to specific examples of the organic pigments and inorganic pigments that may be used in the active energy-curable ink, examples of those which take on a yellow color include monoazo pigments such as C. I. Pigment Yellow 1 (e.g., Fast Yellow G) and C. I. Pigment Yellow 74, disazo pigments such as C. I. Pigment Yellow 12 (e.g., Disazo Yellow AAA) and C. I. Pigment Yellow 17, non-benzidine-based azo pigments such as C. I. Pigment Yellow 180, azolake pigments such as C. I. Pigment Yellow 100 (e.g., Tartrazine Yellow Lake), condensed azo pigments such as C. I. Pigment Yellow 95 (e.g., condensed azo yellow GR), acidic dye lake pigments such as C. I. Pigment Yellow 115 (e.g., Quinoline Yellow Lake), basic dye lake pigments such as C. I. Pigment Yellow 18 (e.g., Thioflavin Lake), anthraquinone pigments such as Flavanthrone Yellow (Y-24), isoindolinone pigments such as Isoindolinone Yellow 3RLT (Y-110), quinophthalone pigments such as Quinophthalone Yellow (Y-138), Isoindoline pigments such as Isoindoline Yellow (Y-139), nitroso pigments such as C. I. Pigment Yellow 153 (e.g., Nickel Nitroso Yellow), and metal complex salt azomethine pigments such as C. I. Pigment Yellow 117 (e.g., copper azomethine yellow).

Examples of those which take on a red or magenta color include monoazo pigments such as C. I. Pigment Red 3 (e.g., Toluidine Red), disazo pigments such as C. I. Pigment Red 38 (e.g., Pyrazolone Red B), azo lake pigments such as C. I. Pigment Red 53:1 (e.g., Lake Red C) and C. I. Pigment Red 57:1 (Brilliant Carmine 6B), condensed azo pigments such as C. I. Pigment Red 144 (e.g., Condensed Azo Red BR), acidic dye lake pigments such as C. I. Pigment Red 174 (e.g., Phloxine B Lake), basic dye lake pigments such as C. I. Pigment Red 81 (e.g., Rhodamine 6G' Lake), anthraquinone pigments such as C. I. Pigment Red 177 (e.g., Dianthraquinonyl Red), thioindigo pigments such as C. I. Pigment Red 88 (e.g., Thioindigo Bordeaux), perinone pigments such as C. I. Pigment Red 194 (e.g., Perinone Red), perylene pigments such as C. I. Pigment Red 149 (e.g., perylene Scarlet), quinacridone pigments such as C. I. Pigment Violet 19 (unsubstituted quinacridone) and C. I. Pigment Red 122 (e.g., Quinacridone Magenta), isoindolinone pigments such as C. I. Pigment Red 180 (e.g., Isoindolinone Red 2BLT) and alizarin lake pigments such as C. I. Pigment Red 83 (e.g., Madder Lake).

Examples of those which take on a blue or cyan color include disazo pigments such as C. I. Pigment Blue 25 (e.g., Dianisidine Blue), phthalocyanine pigments such as C. I. Pigment Blue 15 (e.g., phthalocyanine blue), acidic dye lake pigments such as C. I. Pigment Blue 24 (e.g., Peacock Blue Lake), basic dye lake pigments such as C. I. Pigment Blue 1 (e.g., Victoria Pure Blue BO Lake), anthraquinone-based pigments such as C. I. Pigment Blue 60 (e.g., Indanthrone Blue), and alkali blue pigments such as C. I. Pigment Blue 18 (e.g., Alkali blue V-5:1).

Examples of those which take on a green color include phthalocyanine pigments such as C. I. Pigment Green 7 (Phthalocyanine Green) and C. I. Pigment Green 36 (Phthalocyanine Green), and azo metal complex pigments such as C. I. Pigment Green 8 (Nitroso Green).

Examples of those which take on an orange color include isoindoline pigments such as C. I. Pigment Orange 66 (Isoindoline Orange), and anthraquinone pigments such as C. I. Pigment Orange 51 (Dichloropyranthrone Orange).

Examples of those which take on a black color include carbon black, titanium black, and aniline black.

Specific examples of the white pigments include basic lead carbonate ($2PbCO_3Pb(OH)_2$, so-called silver white), zinc oxide (ZnO, so-called zinc white), titanium oxide ($TiO_2$, so-called titanium white), and strontium titanate ($SrTiO_3$, so-called titanium strontium white).

Among these white pigments, titanium oxide exhibits a small specific gravity, a great refractive index and a high chemical and physical stability as compared with the other white pigments and thus has a great hiding power and coloring power as a pigment. Titanium oxide is also excellent in durability against acid, alkali and other environmental factors. Accordingly, titanium oxide is preferably used for the white pigment. Other white pigments (which may be other than the white pigments described above) may of course be used as necessary.

For the dispersion of pigment, a dispersing machine such as ball mill, sand mill, attritor, roll mill, jet mill, homogenizer, paint shaker, kneader, agitator, Henschel mixer, colloid mill, ultrasonic homogenizer, pearl mill and wet jet mill may be used.

The dispersion of pigment may be effected with a dispersant added. Examples of the dispersant include hydroxyl group-containing carboxylic acid esters, salts of long-chain polyaminoamide with high-molecular weight acid ester, salts of high-molecular weight polycarboxylic acid, high-molecular weight unsaturated acid esters, high molecular copolymers, modified polyacrylates, aliphatic polyvalent carboxylic acids, naphthalenesulfonic acid-formalin condensates, polyoxyethylene alkylphosphoric acid esters, and pigment derivatives. Alternatively, commercially available polymer dispersants such as Solsperse Series (produced by Zeneca Inc.) are preferably used.

A synergist appropriate to the pigment used may be used as the dispersing aid. These dispersants and dispersing aids are preferably added in an amount of from 1 to 50 parts by weight based on 100 parts by weight of the pigment used.

A solvent may be used as the dispersion medium for the various components such as pigment constituting the active energy-curable ink. Alternatively, the aforementioned cationic-polymerizable compound (a), which is a low-molecular weight component, may be used in the absence of a solvent. Since the ink is cured after being applied to the recording medium, it is preferred that no solvents be used. This is because if any solvent remains in the cured ink image, the cured ink shows a deteriorated solvent resistance or the remaining solvent causes VOC (volatile organic compound) problem. It is preferred to use the cationic-polymerizable compound (a) for the dispersion medium from this standpoint of view. It is more preferred to select a cationic-polymerizable monomer having the lowest viscosity from the standpoint of dispersibility or improved handleability of the ink composition.

The average particle diameter of the pigment is preferably from 0.02 μm to 4 μm, more preferably from 0.02 μm to 2 μm, and even more preferably from 0.02 μm to 1.0 μm.

The type of pigment, dispersant and dispersion medium to be used and the dispersion and filtration conditions are predetermined such that the average particle diameter of the pigment particles falls within the desired range as defined above. The particle diameter is controlled to suppress clogging of the head nozzles to maintain the ink storage stability, ink transparency and curing sensitivity.

(Dye)

The dye to be used in the active energy-curable ink is preferably oil-soluble. To be more specific, the solubility of the dye in water at 25° C. (weight of dye to be dissolved in 100 g of water) is 1 g or less, preferably 0.5 g or less, and more preferably 0.1 g or less. Accordingly, a so-called water-insoluble and oil-soluble dye is preferably used.

Now referring to the dye to be used in the active energy-curable ink, an oil-solubilizing group is preferably incorporated in the dye nucleus so that a required amount of dye may be dissolved in the ink.

Examples of the oil-solubilizing group include long-chain and branched alkyl groups, long-chain and branched alkoxy groups, long-chain and branched alkylthio groups, long-chain and branched alkylsulfonyl groups, long-chain and branched acyloxy groups, long-chain and branched alkoxycarbonyl groups, long-chain and branched acyl groups, long-chain and branched acylamino groups, long-chain and branched alkylsulfonylamino groups, long-chain and branched alkylaminosulfonyl groups, and aryl, aryloxy, aryloxycarbonyl, arylcarbonyloxy, arylaminocarbonyl, arylaminosulfonyl and arylsulfonylamino groups containing these long-chain and branched substituents.

Alternatively, a water-soluble dye having a carboxylic acid or sulfonic acid may be reacted with a long-chain and branched alcohol, amine, phenol or aniline derivative to convert the carboxylic acid or sulfonic acid into alkoxycarbonyl group, aryloxycarbonyl group, alkylaminosulfonyl group or arylaminosulfonyl group as an oil-solubilizing group, thereby providing a dye of the invention.

The oil-soluble dye preferably has a melting point of 200° C. or less, more preferably 150° C. or less, and even more preferably 100° C. or less. The use of an oil-soluble dye having a low melting point suppresses the crystallization of the dye in the ink and hence improves the storage stability of the ink.

In order to enhance the resistance to fading, particularly to oxidizing agents such as ozone, and the curing properties, the oxidation potential of the oil-soluble dye is preferably positive (high). To this end, one having an oxidation potential of 1.0 V (vsSCE) or more is preferably used as the oil-soluble dye in the invention. The oxidation potential of the oil-soluble dye is preferably as high as possible, more preferably 1.1 V (vsSCE) or more, and even more preferably 1.15 V (vsSCE) or more.

A compound having the structure represented by the general formula (Y-I) disclosed in JP 2004-250483 A is preferably used for the yellow dye.

Particularly preferred examples of the yellow dye include those represented by the general formulae (Y-II) to (Y-IV) disclosed in JP 2004-250483 A, paragraph [0034]. Specific examples thereof include compounds disclosed in JP 2004-250483 A, paragraphs [0060] to [0071]. The oil-soluble dye of the general formula (Y-I) disclosed therein may be used not only for yellow ink but also any other color ink such as black ink or red ink.

A compound having the structure represented by the general formula (3) or (4) disclosed in JP 2002-114930 A is preferably used for the magenta dye. Specific examples thereof include those disclosed in JP 2002-114930 A, paragraphs [0054] to [0073].

Particularly preferred examples of the magenta dye include azo dyes represented by the general formulae (M-1) and (M-2) disclosed in JP 2002-121414 A, paragraphs [0084] to [0122]. Specific examples thereof include compounds disclosed in JP 2002-121414 A, paragraphs [0123] to [0132]. The oil-soluble dyes of the general formulae (3), (4), (M-1) and (M-2) disclosed therein may be used not only for magenta dye but also for any other color ink such as black ink or red ink.

Preferred examples of the cyan dye include dyes represented by the general formulae (I) to (IV) disclosed in JP 2001-181547 A, and dyes represented by the general formulae (IV-1) to (IV-4) disclosed in JP 2002-121414 A, paragraphs [0063] to [0078]. Specific examples thereof include compounds disclosed in JP 2001-181547 A, paragraphs [0052] to [0066] and JP 2002-121414 A, paragraphs [0079] to [0081].

Particularly preferred examples of the cyan dye include phthalocyanine dyes represented by the general formulae (C-I) and (C-II), and even more preferably (C-II) disclosed in JP 2002-121414 A, paragraphs [0133] to [0196]. Specific examples thereof include compounds disclosed in JP 2002-121414 A, paragraphs [0198] to [0201]. The oil-soluble dyes of the general formulae (I) to (IV), (IV-1) to (IV-4), (C-I) and (C-II) may be used not only for cyan ink but also for any other color ink such as black ink or green ink.

These colorants are preferably incorporated in the ink in an amount of from 1 to 20% by weight, and more preferably from 2 to 10% by weight as calculated in terms of solid content.

In addition to the aforementioned essential components, the active energy-curable ink may also comprise various additives depending on the purpose. These arbitrary components are further described below.

(Ultraviolet Absorber)

In the active energy-curable ink, an ultraviolet absorber may be used from the standpoint of enhanced weather resistance of the image obtained and prevention of the image from fading.

Examples of the ultraviolet absorber include benzotriazole compounds disclosed in JP 58-185677 A, JP 61-190537 A, JP 2-782 A, JP 5-197075 A and JP 9-34057 A; benzophenone compounds disclosed in JP 46-2784 A, JP 5-194483 A and U.S. Pat. No. 3,214,463; cinnamic acid compounds disclosed in JP 48-30492 B, JP 56-21141 B and JP 10-88106 A; triazine compounds disclosed in JP 4-298503 A, JP 8-53427 A, JP 8-239368 A, JP 10-182621 A and JP 8-501291 A; and compounds which absorb ultraviolet ray to emit fluorescence, so-called fluorescent brightening agents, as typified by stilbene and benzoxazole compounds disclosed in Research Disclosure No. 24239.

The amount of ultraviolet absorber added is selected as appropriate for the purpose but is generally from about 0.5 to 15% by weight as calculated in terms of solid content.

(Sensitizer)

The active energy-curable ink may optionally comprise a sensitizer for the purpose of enhancing the acid generation efficiency of the photoacid generator and broadening the wavelength range in which the ink is sensible to light. Any material that can sensitize the photoacid generator by an electron transfer mechanism or energy transfer mechanism may be used for the sensitizer. Preferred examples of the sensitizer include aromatic polycondensed cyclic compounds such as anthracene, 9,10-dialkoxyanthracene, pyrene and perylene; aromatic ketone compounds such as acetophenone, benzophenone, thioxanthone and Michler's ketone; and heterocyclic compounds such as phenothiazine and N-aryloxazolidinone. The amount of sensitizer added is selected as appropriate for the purpose but is generally from 0.01 to 1 mol %, and preferably from 0.1 to 0.5 mol % based on the photoacid generator.

(Antioxidant)

The ink may comprise an antioxidant to enhance the stability thereof. Examples of the antioxidant include those disclosed in EP 223739 A, EP 309401 A, EP 309402 A, EP 310551 A, EP 310552 A and EP 459416 A, DE 3435443 A, JP 54-48535 A, JP 62-262047 A, JP 63-113536 A, JP 63-163351 A, JP 2-262654 A, JP 2-71262 A, JP 3-121449 A, JP 5-61166 A, JP 5-119449 A, U.S. Pat. Nos. 4,814,262 and 4,980,275.

The amount of antioxidant added is selected as appropriate for the purpose but is generally from about 0.1 to 8% by weight as calculated in terms of solid content.

(Discoloration Inhibitor)

The active energy-curable ink may comprise various organic or metal complex-based discoloration inhibitors. Examples of the organic discoloration inhibitor include hydroquinones, alkoxyphenols, dialkoxyphenols, phenols, anilines, amines, indanes, chromanes, alkoxyanilines, and heterocycles. Examples of the metal complex-based discoloration inhibitor include nickel complexes, and zinc complexes. To be more specific, compounds disclosed in patents cited in Research Disclosure No. 17643, VII-I to J, Research Disclosure No. 15162, Research Disclosure No. 18716, left column on page 650, Research Disclosure No. 36544, page 527, Research Disclosure No. 307105, page 872, and Research Disclosure No. 15162 and compounds contained in the general formulae and examples of representative compounds disclosed in JP 62-215272 A, pp. 127-137 can be used.

The amount of discoloration inhibitor added is selected as appropriate for the purpose but is generally from about 0.1 to 8% by weight as calculated in terms of solid content.

(Conductive Salts)

The active energy-curable ink may comprise a conductive salt such as potassium thiocyanate, lithium nitrate, ammonium thiocyanate or dimethylamine hydrochloride for the purpose of controlling the ejectability thereof.

(Solvent)

The active energy-curable ink may also comprise a trace amount of an organic solvent to improve the adhesion to the recording medium.

Examples of the solvent include ketone solvents such as acetone, methyl ethyl ketone and diethyl ketone; alcohol solvents such as methanol, ethanol, 2-propanol, 1-propanol, 1-butanol and tert-butanol; chlorine solvents such as chloroform and methylene chloride; aromatic solvents such as benzene and toluene; ester solvents such as ethyl acetate, butyl acetate and isopropyl acetate; ether solvents such as diethyl ether, tetrahydrofuran and dioxane; and glycol ether solvents such as ethylene glycol monomethyl ether and ethylene glycol dimethyl ether.

In this case, the organic solvent is advantageously added in such an amount that no problems of solvent resistance and VOC may occur. The amount of solvent added is preferably from 0.1 to 5% by weight, and more preferably from 0.1 to 3% by weight based on the total amount of the ink composition.

(Polymer Compound)

The active energy-curable ink may comprise various polymer compounds to adjust the physical properties of the film. Exemplary polymer compounds that may be used include acrylic polymers, polyvinyl butyral resins, polyurethane resins, polyamide resins, polyester resins, epoxy resins, phenol resins, polycarbonate resins, polyvinyl butyral resins, polyvinyl formal resins, shellac, vinyl resins, acrylic resins, rubber resins, waxes, and other natural resins. Two or more of these polymer compounds may be used in combination. Preferred among these polymer compounds are vinyl copolymers obtained by the copolymerization of acrylic monomers. Further, a copolymer containing a "carboxyl group-containing monomer", "methacrylic acid alkyl ester" or "acrylic acid alkyl ester" as a structural unit is preferably used for the copolymer composition of a polymer binder.

(Surfactant)

The active energy-curable ink may comprise a surfactant.

The surfactant used may be any of those disclosed in JP 62-173463 A and JP 62-183457 A. Examples of the surfactant include anionic surfactants such as dialkylsulfosuccinates, alkylnaphthalenesulfonates and aliphatic acid salts; nonionic surfactants such as polyoxyethylene alkyl ethers, polyoxyethylene alkyl allyl ethers, acetylene glycols and polyoxyethylene-polyoxypropylene block copolymers; and cationic surfactants such as alkylamine salts and quaternary ammonium salts. An organic fluoro compound may be used instead of the aforementioned surfactant. The organic fluoro compound is preferably hydrophobic. Examples of the organic fluoro compound include fluorosurfactants, oily fluorine compounds (e.g., fluorinated oil), and solid fluorine compound resins (e.g., polytetrafluoroethylene resin). Specific examples of these organic fluoro compounds include those disclosed in JP 57-9053 A (columns 8 to 17) and JP 62-135826 A.

Besides these additives, a leveling agent, a matting agent, a wax for adjusting the physical properties of the film, a tackifier which doesn't inhibit polymerization to improve adhesion to recording medium made of, for example, polyolefin or PET may be incorporated in the ink.

Specific examples of the tackifier include high-molecular weight tacky polymers disclosed in JP 2001-49200 A, pp. 5-6 (e.g., copolymer comprising ester of (meth)acrylic acid with alcohol having a $C_1$-$C_{20}$ alkyl group, ester of (meth)acrylic acid with $C_3$-$C_{14}$ alicyclic alcohol or ester of (meth)acrylic acid with $C_6$-$C_{14}$ aromatic alcohol), and low-molecular weight tackifying resins having polymerizable unsaturated bond.

(Desirable Physical Properties of Ink)

The active energy-curable ink preferably has a viscosity at the ejection temperature of up to 20 mPa·s, and more preferably up to 10 mPa·s taking into account the ejectability. The composition ratio of the ink is preferably adjusted and determined such that the viscosity thereof falls within the above defined range.

The active energy-curable ink preferably has a common surface tension of from 20 to 40 mN/m, and more preferably from 25 to 35 mN/m. In the case where recording is made on various recording media such as those made of polyolefin and PET, coated paper and uncoated paper, the surface tension of the ink is preferably 20 mN/m or more from the standpoint of spreading and penetration of ink or preferably 40 mN/m or less from the standpoint of wettability.

In the prints obtained with the active energy-curable ink, the image area is cured by exposure to active energy rays such as ultraviolet rays and thus is excellent in strength. Therefore, the active energy-curable ink may be used in various applications as in forming an ink receptive layer (image areas) in a lithographic printing plate in addition to forming an image with ink.

(Radical-polymerizable Ink Composition)

The radical-polymerizable ink composition comprises (d) a radical-polymerizable compound, (e) a polymerization initiator and (f) a colorant. The radical-polymerizable ink composition may further comprise a sensitizing dye, a co-sensitizer, etc. as necessary.

The various components constituting the radical-polymerizable ink composition are sequentially described below.

(d) (Radical-polymerizable Compound)

Examples of the radical-polymerizable compound include the following addition-polymerizable compounds having ethylenically unsaturated bond.

(Addition-polymerizable Compound having Ethylenically Unsaturated Bond)

Examples of the addition-polymerizable compounds having ethylenically unsaturated bond that may be used in the active energy-curable ink include esters of unsaturated carboxylic acids (e.g., acrylic acid, methacrylic acid, itaconic acid, crotonic acid, isocrotonic acid, maleic acid) with aliphatic polyhydric alcohol compounds, and amides of the aforementioned unsaturated carboxylic acids with aliphatic polyhydric amine compounds.

Referring now to specific examples of monomers of esters of aliphatic polyhydric alcohols with unsaturated carboxylic acids, exemplary acrylic acid esters include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl)isocyanurate, and polyester acrylate oligomer.

Exemplary methacrylic acid esters include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy)phenyl]dimethylmethane, and bis-[p-(acryloxyethoxy)phenyl]dimethylmethane. Exemplary itaconic acid esters include ethylene glycol diitaconate, propylene glycol diitaconate, 1,3-butanediol diitaconate, 1,4-butane diol diitaconate, tetramethylene glycol diitaconate, pentaerythritol diitaconate, and sorbitol tetraitaconate.

Exemplary crotonic acid esters include ethylene glycol dicrotonate, tetramethylene glycol dicrotonate, pentaerythritol dicrotonate, and sorbitol tetradicrotonate. Exemplary isocrotonic acid esters include ethylene glycol diisocrotonate, pentaerythritol diisocrotonate, and sorbitol tetraisocrotonate. Exemplary maleic acid esters include ethylene glycol dimaleate, triethylene glycol dimaleate, pentaerythritol dimaleate, and sorbitol tetramaleate. Mixtures of the aforementioned ester monomers may be also used. Specific examples of the monomers of amides of aliphatic polyhydric amine compounds with unsaturated carboxylic acids include methylenebis-acrylamide, methylenebis-methacrylamide, 1,6-hexamethylenebis-acrylamide, 1,6-hexamethylenebis-methacrylamide, diethylenetriamine trisacrylamide, xylylene bisacrylamide, and xylylenebismethacrylamide.

Other exemplary monomers include vinylurethane compounds having two or more polymerizable vinyl groups in one molecule obtained by adding a vinyl monomer containing a hydroxyl group represented by the general formula (A): $CH_2{=}C(R)COOCH_2CH(R')OH$ (in which R and R' each represent H or $CH_3$) to a polyisocyanate compound having two or more isocyanate groups in one molecule as disclosed in JP 48-41708 B.

Further exemplary monomers include polyfunctional acrylates and methacrylates such as urethane acrylates as disclosed in JP 51-37193 A, polyester acrylates as disclosed in JP 48-64183 A, JP 49-43191 B and JP 52-30490 B and epoxy acrylates obtained by the reaction of epoxy resin with (meth) acrylic acid. Moreover, those disclosed as photosetting monomer and oligomer in "The Journal of the Adhesion Society of Japan", Vol. 20, No. 7, pp. 300-308, 1984 may be used. In the invention, these monomers may be used in such chemical forms as prepolymer, i.e., dimer, trimer, oligomer, and a mixture and a copolymer thereof.

The amount of the radical-polymerizable compound used is usually from 1% to 99.99%, preferably from 5% to 90.0%, and more preferably from 10% to 70% based on the total amount of the components of the ink (The term "%" as used herein is % by weight).

(e) (Photopolymerization Initiator)

The photopolymerization initiator to be used in the radical-polymerizable ink composition is further described below.

The photopolymerization initiator of the invention is a compound which causes a chemical change under the action of light or under the interaction with the sensitizing dye in the electronically excited state to produce at least one of radical, acid and base.

Preferred examples of the photopolymerization initiator include (a) aromatic ketones, (b) aromatic onium salt compounds, (c) organic peroxides, (d) hexaaryl biimidazole compounds, (e) ketoxime ester compounds, (f) borate compounds, (g) adinium compounds, (h) metallocene compounds, (i) active ester compounds, and (j) compounds having carbon-halogen bond.

(f) (Colorant)

The colorant (f) used may be the same as the colorant (c) described for the cationic-polymerizable ink composition.

In addition to the aforementioned essential components, the active energy-curable ink may also comprise various additives depending on the purpose. These arbitrary components are further described below.

(Sensitizing Dye)

The active energy-curable ink may also comprise a sensitizing dye for the purpose of enhancing the sensitivity of the photopolymerization initiator. Preferred examples of the sensitizing dye include those belonging to the following compound group having an absorption wavelength of from 350 nm to 450 nm.

Polynuclear aromatic compounds (e.g., pyrene, perylene, triphenylene), xanthenes (e.g., fluorescein, eosine, erythrosine, rhodamine B, rose bengal), cyanines (e.g., thiacarbocyanine, oxacarbocyanine), merocyanines (e.g., merocyanine, carbomerocyanine), thiazines (e.g., thionine, methylene blue, toluidine blue), acridines (e.g., acridine orange, chloroflavin, acriflavin), anthraquinones (e.g., anthraquinone), squaryliums (e.g., squarylium), and coumarins (e.g., 7-diethylamino-4-methylcoumarin).

(Co-sensitizer)

The active energy-curable ink may further comprise as a co-sensitizer a known compound which has an effect of further enhancing sensitivity or suppressing the inhibition of polymerization by oxygen.

Examples of such a co-sensitizer include amines such as compounds disclosed in M. R. Sander et al., "Journal of Polymer Society", Vol. 10, page 3,173, 1972, JP 44-20189 B, JP 51-82102 A, JP 52-134692 A, JP 59-138205 A, JP 60-84305 A, JP 62-18537 A, JP 64-33104 A and Research Disclosure No. 33825. Specific examples of these compounds include triethanolamine, ethyl p-dimethylaminobenzoate, p-formyldimethylaniline, and p-methylthiodimethylaniline.

Other examples of the co-sensitizer include thiols and sulfides such as thiol compounds disclosed in JP 53-702 A, JP 55-500806 B and JP 5-142772 A and disulfide compounds disclosed in JP 56-75643 A. Specific examples of these compounds include 2-mercaptobenzothiazole, 2-mercaptobenzoxaole, 2-mercaptobenzimidazole, 2-mercapto-4(3H)-quinazoline, and β-mercaptonaphthalene.

Further examples of the co-sensitizer include amino acid compounds (e.g., N-phenylglycine), organic metal compounds (e.g., tributyltin acetate) disclosed in JP 48-42965 B, hydrogen donors disclosed in JP 55-34414 B, sulfur compounds (e.g., trithiane) disclosed in JP 6-308727 A, phosphorus compounds (e.g., diethyl phosphite) disclosed in JP 6-250387 A, and Si—H and Ge—H compounds disclosed in Japanese Patent Application No. 6-191605.

From the standpoint of enhancing the storage stability, a polymerization inhibitor is preferably incorporated in an amount of from 200 ppm to 20,000 ppm. The active energy-curable ink is preferably heated to a temperature of from 40° C. to 80° C. to have a lower viscosity before being ejected. A polymerization inhibitor is preferably added also in order to prevent clogging of the ink-jet head due to thermal polymerization. Examples of the polymerization inhibitor include hydroquinone, benzoquinone, p-methoxyphenol, TEMPO, TEMPOL, and Cupferron Al.

(Others)

Besides these additives, known compounds may be used as necessary. For example, a surfactant, a leveling agent, a matting agent, a polyester resin for adjusting the physical properties of a film, a polyurethane resin, a vinyl resin, an acrylic resin, a rubber resin, and a wax may be properly selected and used. Further, a tackifier which doesn't inhibit polymerization is preferably incorporated in the ink to enhance the adhesion of the ink to the recording medium made of, for example, polyolefin or PET. Specific examples of the tackifier include high-molecular weight tacky polymers disclosed in JP 2001-49200 A, pp. 5-6 (e.g., copolymer comprising ester of (meth) acrylic acid with alcohol having a $C_1$-$C_{20}$ alkyl group, ester of (meth)acrylic acid with $C_3$-$C_{14}$ alicyclic alcohol or ester of (meth)acrylic acid with $C_6$-$C_{14}$ aromatic alcohol), and low-molecular weight tackifying resins having polymerizable unsaturated bond.

The active energy-curable ink may also comprise a trace amount of an organic solvent to improve the adhesion to the recording medium. In this case, the organic solvent is advantageously added in such an amount that no problems of solvent resistance and VOC may occur. The amount of solvent added is preferably from 0.1 to 5% by weight, and more preferably from 0.1 to 3% by weight based on the total amount of the ink composition.

In a preferred embodiment, a cationic-polymerizable monomer having a long life is combined with a polymerization initiator to form a radical/cationic hybrid curable ink to prevent a decrease of the sensitivity due to the light shielding effect of the ink coloring material.

(Aqueous Ink Composition)

The aqueous ink composition comprises a polymerizable compound and a water-soluble photopolymerization initiator which produces radicals under the action of active energy. The aqueous ink composition may further comprise a coloring material, as desired.

(Polymerizable Compound)

A polymerizable compound incorporated in known aqueous ink compositions may be used for the polymerizable compound in the aqueous ink composition.

The aqueous ink composition may comprise a reactive material to provide an optimized formulation taking into account the end user properties such as curing rate, adhesion and flexibility. Examples of the reactive material include (meth)acrylate (i.e., acrylate and/or methacrylate) monomers and oligomers, epoxides, and oxetanes.

Examples of the acrylate monomers include phenoxyethyl acrylate, octyldecyl acrylate, tetrahydrofuryl acrylate, isobornyl acrylate, hexanediol diacrylate, trimethylolpropane triacrylate, pentaerythritol triacrylate, polyethylene glycol diacrylate (e.g., tetraethylene glycol diacrylate), dipropylene glycol diacrylate, tri(propyleneglycol) triacrylate, neopentyl glycol diacrylate, bis(pentaerythritol) hexaacrylate, acrylate of ethoxylated or propoxylated glycol (e.g., propoxylated neopentyl glycol diacrylate, ethoxylated trimethylolpropane triacrylate), and mixtures thereof.

Examples of the acrylate oligomers include ethoxylated polyethylene glycol, ethoxylated trimethylolpropane acrylate, polyether acrylate, ethoxylation product thereof, and urethane acrylate oligomers.

Examples of the methacrylates include hexanediol dimethacrylate, trimethylolpropane trimethacrylate, triethylene glycol dimethacrylate, diethylene glycol dimethacrylate, ethylene glycol dimethacrylate, 1,4-butanediol dimethacrylate, and mixtures thereof.

The amount of oligomer added is preferably from 1% to 80% by weight, and more preferably from 1% to 10% by weight based on the total amount of the ink.

(Water-soluble Photopolymerization Initiator which Produces Radicals Under the Action of Active Energy)

The polymerization initiator that may be used in the active energy-curable ink is described below. An example of the polymerization initiator is a photopolymerization initiator which acts on light with a wavelength of up to around 400 nm. Examples of such a photopolymerization initiator include photopolymerization initiators represented by the following general formulae (hereinafter referred to as "TX Series") which exhibit functionality in a long wavelength range, that is, which is sensitive to ultraviolet rays to produce radicals. In the invention, it is particularly preferred to select and use the photopolymerization initiator as appropriate from these examples.

TX-1

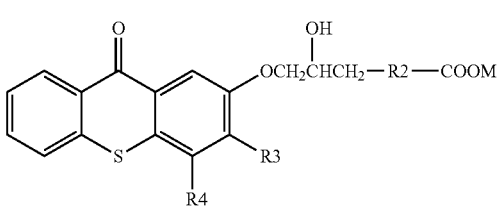

TX-2

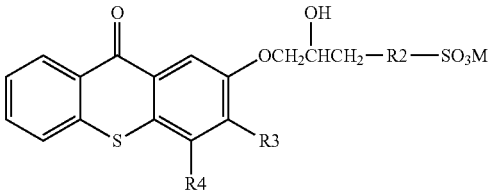

-continued

TX-3

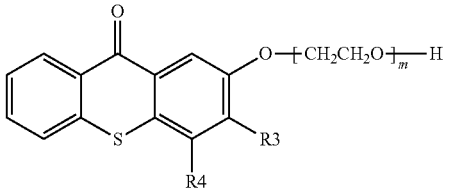

In the general formulae TX-1 to TX-3, R2 represents —$(CH_2)_x$-(in which x is 0 or 1), —O—$(CH_2)_y$-(in which y is 1 or 2) or substituted or unsubstituted phenylene group. In the case where R2 is a phenylene group, at least one of the hydrogen atoms in the benzene ring may be substituted by one or more groups or atoms selected from the group consisting of carboxyl groups or salts thereof, sulfonic acids or salts thereof, $C_1$-$C_4$ straight-chain or branched alkyl groups, halogen atoms (e.g., fluorine, chlorine, bromine), $C_1$-$C_4$ alkoxyl groups and aryloxy groups such as phenoxy group. M represents a hydrogen atom or an alkaline metal (e.g., Li, Na, K). R3 and R4 each independently represent a hydrogen atom or a substituted or unsubstituted alkyl group. Examples of the alkyl group include straight-chain or branched alkyl groups having from about 1 to 10 carbon atoms, particularly preferably from about 1 to 3 carbon atoms. Examples of substituents on these alkyl groups include halogen atoms (e.g., fluorine, chlorine, bromine), hydroxyl groups, and alkoxyl groups (having from about 1 to 3 carbon atoms). The suffix m represents an integer of from 1 to 10.

In the invention, water-soluble derivatives of the photopolymerization initiator Irgacure 2959 (Trade name; produced by Ciba Specialty Chemicals) represented by the following general formula (hereinafter abbreviated as "IC Series") may be used. More specifically, IC-1 to IC-3 represented by the following general formulae may be used.

General formula

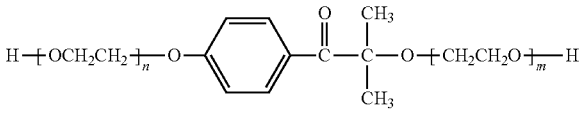

(n = 2~5, m = 0~5)

IC-1

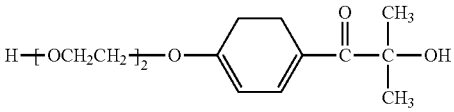

IC-2

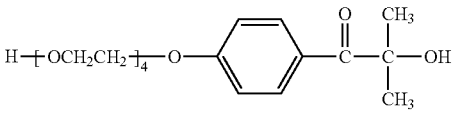

IC-3

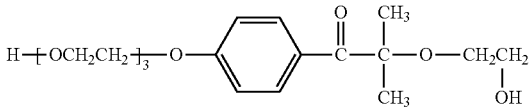

(Formulation for Clear Ink)

The water-soluble polymerizable compound may be in the form of a transparent aqueous ink free of the coloring materials so as to form a clear ink. In particular, an aqueous photosetting clear ink for ink-jet recording can be obtained by preparing the ink such that the ink may have ink-jet recording properties. Use of such ink enables a clear film to be obtained owing to the absence of coloring materials. Referring to the usage of clear ink free of coloring materials, the clear ink may be used for the undercoat imparting image printability to the recording medium or for the overcoat to protect the surface of an image formed with ordinary ink or to further decorate or give gloss. A colorless pigment or fine particles which are not intended for coloring may be dispersed in the clear ink depending on the applications. Addition of such material enables enhancement of such properties as image quality, fastness and workability (handleability) of prints obtained, no matter whether the undercoat or overcoat is made from the ink.

The ink composition to be applied to the clear ink is preferably prepared such that the content of the water-soluble polymerizable compound which is a main component of the ink is from 10% to 85%, and the content of the photopolymerization initiator (e.g., catalyst for ultraviolet polymerization) is from 1 to 10 parts by weight based on 100 parts by weight of the water-soluble polymerizable compound and at least 0.5 parts by weight based on 100 parts by weight of the ink.

(Materials Constituting Ccoloring Material-containing Ink)

In the case where the water-soluble polymerizable compound is used in the ink containing coloring materials, it is preferred that the concentrations of the polymerization initiator and the polymerizable material in the ink be adjusted according to the absorption characteristics of the coloring materials in the ink. As previously mentioned, water or a solvent is incorporated in an amount of 40% to 90% by weight, and preferably from 60% to 75% by weight. The content of the polymerizable compound in the ink is from 1% to 30% by weight, and preferably from 5% to 20% by weight based on the total amount of the ink. The content of the polymerization initiator depends on the content of the polymerizable compound, but is generally from 0.1% to 7% by weight, and preferably from 0.3% to 5% by weight based on the total amount of the ink.

In the case where a pigment is used as the ink coloring material, the concentration of the pure pigment in the ink is generally from 0.3% to 10% by weight based on the total amount of the ink. The staining power of the pigment depends on how pigment particles are dispersed. When the concentration of the pigment falls within a range of from about 0.3% to 1%, the resulting ink can be used as a light-colored ink. When the concentration of the pigment exceeds the above range, the resulting ink has a pigment concentration for ordinary coloring.

The undercoat liquid preferably has at least a different composition from that of the ink. It is preferable for the undercoat liquid to have at least one polymerizable or crosslinkable material and optionally a polymerization initiator, a lipophilic solvent, a colorant and other components.

The polymerization initiator may preferably initiate a polymerization reaction or crosslinking reaction making use of active energy rays. The undercoat liquid applied to the recording medium can be thus cured by exposure to active energy rays.

The undercoat liquid preferably comprises a radical-polymerizable composition. The radical-polymerizable composition in the invention is a composition comprising at least one radical-polymerizable material and at least one radical polymerization initiator. Such a composition enables the undercoat liquid curing reaction to be carried out at a high sensitivity in a short period of time.

Although embodiments of the image forming device and label printer of the present invention have been described for illustrative purposes, it is to be understood that various modifications and improvements are possible without departing from the scope and spirit of the invention as disclosed in the accompanying claims.

What is claimed is:

1. A label printer for making labels on a web-type recording medium which is composed of a backing sheet and an adhesive sheet laminated on said backing sheet, comprising:

an image forming section for forming first label images on a surface of said adhesive sheet;

a printing defect detecting section for detecting second label images with a printing defect from said first label images formed by said image forming section;

a printing defect marking section for placing a mark on said second label images with the printing defect having been detected; and a post-treatment section for post-treating said surface of said adhesive sheet of said web-type recording medium having said first label images formed thereon by said image forming section, wherein said post-treatment section comprises:

a cutting section for making label-shaped slits in said adhesive sheet according to said first label images;

a controlling section for controlling said cutting section not to operate for said second label images having said mark formed thereon; and a peeling section for peeling off non-label portions of said adhesive sheet having said label-shaped slits made by said cutting section from said backing sheet; and wherein when the peeling section peels off the non-label portions of the adhesive sheet, the peeling section peels off the second label images together with the non-label portions so as to remove images with printing defects.

2. The label printer according to claim 1, wherein said image forming section is for forming said first label images by means of an ink-jet head.

3. The label printer according to claim 2, wherein said printing defect detecting section is for detecting said second label images by detecting an ejection failure of said ink-jet head.

4. The label printer according to claim 1, wherein said image forming section is for forming said first label images based on previously stored second image data, and said printing defect detecting section is for comparing first image data obtained by reading one of said first label images formed by said image forming section with one of said second image data used for forming said one of said first label images, and detecting whether or not said one of said first label images is one of said second images.

5. The label printer according to claim 1, further comprising:

a storage section for previously storing second image data to be used for forming said first label images; and image detecting means for reading one of said first label images formed by said image forming section to obtain first image data, wherein said printing defect detecting section is for comparing said first image data obtained by said image detecting section with one of said second image data used for forming said one of said first label images, and determining whether or not said one of said first label images is one of said second images.

6. The label printer according to claim 1, wherein said cutting section is a laser cutter which does not make label-shaped slits in said adhesive sheet according to the second label images with the printing defect.

7. A method of making labels on a web-type recording medium which is composed of a backing sheet and an adhesive sheet laminated on said backing sheet, comprising steps of:

forming first label images on a surface of said adhesive sheet;

detecting second label images with a printing defect from said formed first label images;

placing a mark on said second label images with the printing defect having been detected; and post-treating said surface of said adhesive sheet of said web-type recording medium having said first label images formed thereon, wherein said step of post-treating comprises steps of:

making label-shaped slits in said adhesive sheet according to said first label images and not making said label shaped slits in said adhesive sheet for said second label images having said mark formed thereon; and peeling off non-label portions of said adhesive sheet having said label-shaped slits from said backing sheet; and wherein peeling off the non-label portions of the adhesive sheet includes peeling off the second label images together with non-label portions so as to remove images with printing defects.

8. The method according to claim 7, wherein said label-shaped slits are not made in said adhesive sheet according to the second label images with the printing defect.

9. The method according to claim 7, wherein said first label images are formed by means of an ink jet head that uses ink which is curable upon exposure to active energy rays.

10. The method according to claim 9, wherein said second label images are detected by detecting an ejection failure of said ink-jet head.

11. The method according to claim 7, further comprising:

forming said first label images based on previously stored second image data, comparing first image data obtained by reading one of said formed first label images with one of said second image data used for forming said one of said first label images, and detecting whether or not said one of said first label images is one of said second images.

* * * * *